US009135771B2

(12) United States Patent
Anderson

(10) Patent No.: US 9,135,771 B2
(45) Date of Patent: Sep. 15, 2015

(54) MEMENTO DISPENSING DEVICE WITH SIMULATED GAMING FEATURES

(76) Inventor: Kent Steven Anderson, Excelsior, MN (US)

( * ) Notice: Subject to any disclaimer, the term of this patent is extended or adjusted under 35 U.S.C. 154(b) by 2618 days.

(21) Appl. No.: 11/588,679

(22) Filed: Oct. 27, 2006

(65) Prior Publication Data

US 2007/0105610 A1 May 10, 2007

Related U.S. Application Data

(60) Provisional application No. 60/733,545, filed on Nov. 4, 2005.

(51) Int. Cl.
*A63F 9/00* (2006.01)
*G07F 17/32* (2006.01)

(52) U.S. Cl.
CPC ..... *G07F 17/32* (2013.01); *G07F 17/3227* (2013.01); *G07F 17/3253* (2013.01)

(58) Field of Classification Search
USPC ..... 463/16–20
See application file for complete search history.

(56) References Cited

U.S. PATENT DOCUMENTS

| | | | | |
|---|---|---|---|---|
| 3,901,366 | A * | 8/1975 | Schuller et al. | 194/210 |
| 4,225,056 | A | 9/1980 | Flubacker | |
| 4,518,098 | A | 5/1985 | Fleischer | |
| 5,058,893 | A | 10/1991 | Dickinson et al. | |
| 5,366,110 | A | 11/1994 | Takemoto et al. | |
| 5,397,125 | A | 3/1995 | Adams | |
| 5,593,349 | A * | 1/1997 | Miguel et al. | 463/30 |
| 5,836,819 | A | 11/1998 | Ugawa | |
| 5,971,397 | A * | 10/1999 | Miguel et al. | 273/371 |
| 6,148,148 | A * | 11/2000 | Wain et al. | 396/2 |
| 6,200,217 | B1 | 3/2001 | Osawa | |
| 6,270,412 | B1 | 8/2001 | Crawford et al. | |
| 6,287,194 | B1 | 9/2001 | Okada et al. | |
| 6,293,865 | B1 * | 9/2001 | Kelly et al. | 463/16 |
| 6,324,520 | B1 | 11/2001 | Walker et al. | |
| 6,517,433 | B2 | 2/2003 | Loose et al. | |
| 6,537,152 | B2 | 3/2003 | Seelig et al. | |
| 6,558,253 | B1 | 5/2003 | DeSimone et al. | |
| 6,565,433 | B1 | 5/2003 | Baerlocher et al. | |
| 6,641,477 | B1 | 11/2003 | Dietz, II | |

(Continued)

OTHER PUBLICATIONS

Corresponding Canadian Patent Application No. CA 2,525,905, Publication Date: May 4, 2007.

(Continued)

*Primary Examiner* — Seng H Lim
(74) *Attorney, Agent, or Firm* — Michael A. Mochinski

(57) ABSTRACT

A memento dispensing device for dispensing mementos in the form of tokens, medallions, souvenirs, and other articles or objects having commemorative value through the simulated operation of a gaming device commonly referred to and known in the art as a slot machine. Instructive steps set forth in a computer program, as executed and controlled by a main microcontroller, serve to direct and command the memento dispensing device to dispense at least one memento to the consumer or operator upon the consummation of a spin cycle for a set of mechanical reel wheels or simulated reel wheels on a video display. The main microcontroller, operating under the direction of the computer program, further directs the timed playback of video and audio stored on recognizable formats and activates lights at select moments during operation and after every instance the memento is dispensed from the memento dispensing device.

96 Claims, 20 Drawing Sheets

(56) References Cited

U.S. PATENT DOCUMENTS

| | | | | |
|---|---|---|---|---|
| 6,676,510 | B1 | 1/2004 | Bittman et al. | |
| 6,682,422 | B1 | 1/2004 | Walker et al. | |
| 6,780,106 | B2 * | 8/2004 | DeMar et al. | 463/16 |
| 6,890,259 | B2 * | 5/2005 | Breckner et al. | 463/29 |
| 7,442,125 | B2 * | 10/2008 | Paulsen et al. | 463/30 |
| 2002/0077169 | A1 * | 6/2002 | Kelly et al. | 463/16 |
| 2003/0022710 | A1 * | 1/2003 | DeMar et al. | 463/16 |
| 2003/0083132 | A1 * | 5/2003 | Berg et al. | 463/40 |
| 2003/0153381 | A1 * | 8/2003 | Slattery | 463/16 |
| 2004/0002374 | A1 * | 1/2004 | Brown et al. | 463/20 |
| 2004/0005918 | A1 * | 1/2004 | Walker et al. | 463/16 |
| 2004/0053684 | A1 | 3/2004 | Chudd et al. | |
| 2004/0082377 | A1 * | 4/2004 | Seelig et al. | 463/17 |
| 2004/0192434 | A1 * | 9/2004 | Walker et al. | 463/25 |
| 2005/0282613 | A1 * | 12/2005 | Pryzby et al. | 463/20 |
| 2006/0003829 | A1 * | 1/2006 | Thomas | 463/20 |
| 2006/0116194 | A1 * | 6/2006 | Pacey et al. | 463/20 |
| 2006/0148551 | A1 * | 7/2006 | Walker et al. | 463/16 |
| 2007/0281775 | A1 * | 12/2007 | Kashima | 463/20 |
| 2007/0287533 | A1 * | 12/2007 | Amour | 463/26 |
| 2008/0076571 | A1 * | 3/2008 | Frerking | 463/42 |
| 2009/0017896 | A1 * | 1/2009 | Page | 463/20 |

OTHER PUBLICATIONS

Corresponding PCT Patent Application No. WO2007/055949, Publication Date: May 18, 2007.

* cited by examiner

164

172

MEMENTO DISPENSING DEVICE WITH SIMULATED GAMING FEATURES

CROSS-REFERENCE TO RELATED APPLICATIONS

This application claims the benefit of U.S. Provisional Application No. 60/733,545, filed Nov. 4, 2005, entitled "Memento Dispensing Device with Simulated Gaming Features," the disclosures of which, including all attached documents, are incorporated herein by reference in their entirety for all purposes.

FIELD OF THE INVENTION

The present invention relates in general to a memento dispensing device for dispensing tokens, medallions, souvenirs, and other articles or objects having commemorative value. More specifically, the present invention, in addition to its primary function for dispensing mementos, comprises supplemental means for allowing one to engage in interactive activities, including the viewing of pre-selected video feeds and participating in a simulated gaming event momentarily after depositing a predetermined sum of currency, whereupon such interactive activities may further an establishment's opportunity to advertise or promote a certain product or service, commemorate a particular event or occasion, or advance an establishment's theme.

BACKGROUND OF THE INVENTION

This patent application will describe the memento selling trade, the occasions when mementos are sold, the current challenges to implementing a successful marketing and advertising strategy using mementos and a novel solution to these challenges. Mementos are distributed or sold in commerce by a variety of means, some of which may involve direct sale by onsite sales personnel or an automated device such as a vending machine. Automated devices of this type may be regarded as the preferred manner in transacting a memento sale given their efficient, accurate handling of a high volume of sales in a centralized location or deployment of an inexpensive workforce to cover a large territory of smaller transactions. Automated devices can vary significantly in size, shape and form, but all operate on the common principle of a direct exchange of money for a memento, whether it is in a form of a token, medallion, souvenir, and other article or object having commemorative value.

The memento in a form of a token, for example, may be further utilized in a commercial transaction similar to that involving currency, which may be exchanged at a later time for a purchase of a good or service, activation of an entertainment device such as an arcade game or simply kept in its own right for its commemorative value and appeal. In the past, sellers of mementos have applied very few creative approaches to their trade. One such creative approach may involve active participation of the purchaser to create a memento using an onsite press and stamp machine which accepts for a nominal fee a relatively low value coin, such as a United States penny, and converts it into a uniquely shaped token to commemorate an event, occasion or attraction. Part of the appeal of such an exchange can be attributed to user participation in creating and obtaining a unique token through manipulation of hand-crank rollers and selection of a design-bearing stamp to be mechanically reproduced and transferred onto the coin's face.

The opportunity to sell mementos has traditionally been observed on two occasions: arcade establishments with coin operated entertainment equipment and impulse purchases by tourists at tourist attractions. Arcades, for example, may use a memento in the form of a token bearing a design unique to the establishment in lieu of currency to centralize the collection of money and practice their trade without dependency on the current supply of the appropriate denomination of coined money. In other memento transactions, a tourist may purchase a token, souvenir or medallion for its commemorative value, and as discussed earlier, actively participate in its creation by selecting a stamp bearing words and images which coincide with a particular tourist attraction or theme park.

The opportunity to expand the use and sale of mementos, particularly tokens, depends on overcoming current challenges to implementing a successful marketing and advertising strategy. Such challenges include the inexistence of a memento dispensing device which integrally attracts patrons for a predetermined amount of time insofar to permit one to engage in an interactive event and purchase a memento while simultaneously affording an establishment the opportunity to gain the attention of the consumer to promote or advertise a certain product or service.

A memento dispensing device comprising the strategic arrangement of lights, sounds and music can collectively attract patrons to the memento dispensing device to make a memento purchase and momentarily observe decorative and video displays which depict promotional offerings being made by the establishment. Memento dispensing devices incorporating these entertaining functions could serve as a novelty item to further the establishment's theme or to promote a business by selling tokens and the like in a fun and exciting manner for the exchange of a good or service at a later time.

Gaming devices such as a typical slot machine offer an inherent attraction to patrons. However, such devices are categorically games of chance where the excitement is primarily associated with their operation, such as the pulling of a lever or pressing a button to set in rotational motion reels bearing a collection of symbols or images of some sort. Although this operation comprises entertaining value to some, the net transaction may or may not yield a payment. In general, such devices by their design operate to avoid providing a payment on each transaction in favor of providing a more random pattern of small to large payments between extended periods of nonpayment. Harnessing the attraction and excitement of pulling a lever or pressing a button and observing the rotation of reels would greatly enhance the experience of purchasing a memento, even more so than the traditional direct money for memento exchange manner common to the memento selling trade.

Currently, gaming devices such as slot machines are categorically considered illegal in some jurisdictions or locations throughout the United States and the world given their stature as a game of chance. Gaming devices lacking the game of chance element while functioning in the capacity as a memento selling device may rightfully and readily permit their use in most jurisdictions where games of chance are prohibited. As gaming devices become old, worn or their technology becomes obsolete, they are replaced with new gaming devices incorporating the latest technologies, thus creating a surplus of used equipment of relatively low value because of their inability to serve any other function besides gaming. This shortfall is readily apparent in the marketplace and represents an opportunity to redeploy these devices using their inherent entertaining capabilities for enhanced marketing and advertising programs or strategies which creatively promote the sale of a good or service of a business or establishment.

In light of the above, a memento dispensing device possessing the abilities to predominately display information about the particular establishment while simultaneously affording a level of entertainment to the consumer for a nominal sum may be desirable to establishments in gaining a greater market share for their product or service. However, in order to be effective, displays and the like bearing advertisements or promotional offerings must be integrated into the body of the device and be readily apparent to the consumer while engaging in the interactive event and consummating the sale of mementos. The memento dispensing device must effectively garner the attention of patrons and increase the excitement of the experience through the use of lights, sound, music, and video. Random light and sound displays integrated into the memento dispensing device can attract the attention of patrons to expose them to strategically placed advertisements for an enhanced marketing campaign. Such devoted advertising space can effectively promote an establishment's product or service. In some instances, the memento dispensing device may be dressed with the establishment's logo to create a themed experience to supplement its inherent entertaining capabilities. Moreover, the memento dispensing device may serve as supplemental means of added revenue through the sale of mementos and advertisements of other companies, establishments, and the like.

A device such as the one described above will create new marketing and advertising strategies. By harnessing the attractiveness of gaming devices to permit the sale of mementos in a manner palatable to the laws of most jurisdictions, such devices can be readily placed in an establishment for initial use to dispense tokens which can be redeemed at a later time for a good or service as previously mentioned. One can easily envision the deployment of a number of memento dispensing devices particularly suited for operation at an establishment to attract and entertain customers while garnering the consumer's attention to observe displayed advertisements. In order to make such a marketing strategy a reality, the memento dispensing device must inherently attract and entertain customers for a predetermined amount of time to sufficiently permit observation of advertisements predominately displayed on video and appearing elsewhere on the device while the consumer consummates the sale of a memento.

BRIEF SUMMARY OF THE INVENTION

Surprisingly, the above objectives can be satisfied in a single memento dispensing device capable of attracting customers by its inherent design, with devoted advertising space to promote a product or service of an establishment. The memento dispensing device sells mementos in the form of tokens, medallions, souvenirs, and other articles or objects having commemorative value through the simulated operation of a gaming device commonly referred to and known in the art as a slot machine. A process controller executes appropriate instructive steps or commands to dispense at least one memento to the consumer after consummating a reel spin cycle or simulated reel spin cycle on a video display. The process controller further directs the playback of video footage and timed audio and displays lights after every instance a memento is dispensed from the memento dispensing device. The memento dispensing device comprises primary and secondary translucent surfaces for strategic placement of advertisements and other promotional offerings of an establishment. These translucent surfaces are preferentially integrated into the memento dispensing device to avoid vandalism and can readily accept decorative panels for alteration of advertisements. In some instances, it may be appropriate or desirable to illuminate each of the translucent surfaces from behind to further highlight the advertisement and distinguish the memento dispensing device from among other physical features and fixtures predominately present at an establishment.

Gaming devices are categorically considered illegal in most jurisdictions given their stature as a game of chance. The present invention is limited in exchanging currency for mementos without presenting any opportunity to engage in a game of chance. The memento dispensing device is capable of exchanging common forms of currency, including paper and coins of various denominations, for a memento in the form of a token, medallion, souvenir, and any other article or object having commemorative value. Mementos are sold by inserting the established denomination of currency into the memento dispensing device and pulling a lever or pressing downwardly on a button to set in rotational motion a set of reel wheels each of which comprise a plurality of symbols or images selectively arranged on the circumferential periphery thereof. After expiration of a predetermined time interval, the mechanical or video simulated reel wheels sequentially stop from left to right to depict a pre-defined arrangement of symbols or images through divided display windows integrated into an access door of the present invention. After the reel wheels have collectively stopped in this predetermined manner, at least one memento is dispensed from a protected reserve into a reservoir readily accessible to the consumer.

During and after the memento sales transaction, the consumer is further entertained by pre-selected video footage predominately displayed on a monitor generally situated behind the upper primary translucent surface. The memento dispensing device by its inherent design is suitably attractive to the occasioned customer, particularly upon the activation of lights and sound at timed intervals. Further attention to the memento dispensing device may be realized by the continuous activation of lights and sound as natural curiosity will cause a passerby to investigate the origin of the lights or sounds the memento dispensing device emits. In further respects, lights and sounds operating in concert to coincide with strategically placed advertisement can enhance the effectiveness of any marketing campaign.

The objects and advantages of the present invention will become more apparent in light of the following detailed description of illustrative embodiments of this invention, specifically in the capacity of being described in connection with the drawings.

BRIEF DESCRIPTION OF THE SEVERAL VIEWS OF THE DRAWINGS

A preferred embodiment of the present invention will now be described by way of example with reference to the accompanying drawings, in which.

DETAILED DESCRIPTION OF THE PREFERRED EMBODIMENT

While this invention is susceptible of being embodied in many different forms, the preferred embodiment of the invention is illustrated in the accompanying drawings and described in detail hereinafter with the understanding that the present disclosure is to be considered to exemplify the principles of the present invention and is not intended to unduly limit the invention to the embodiments illustrated and presented herein. The present invention has particular utility as an apparatus for dispensing a memento having commemorative value after momentarily engaging and completing an interactive, simulated gaming experience, an interactive event which may further an establishment's opportunity to advertise or promote a certain product or service or advance an amusement center's theme upon one's receipt of the memento.

Figure 1:
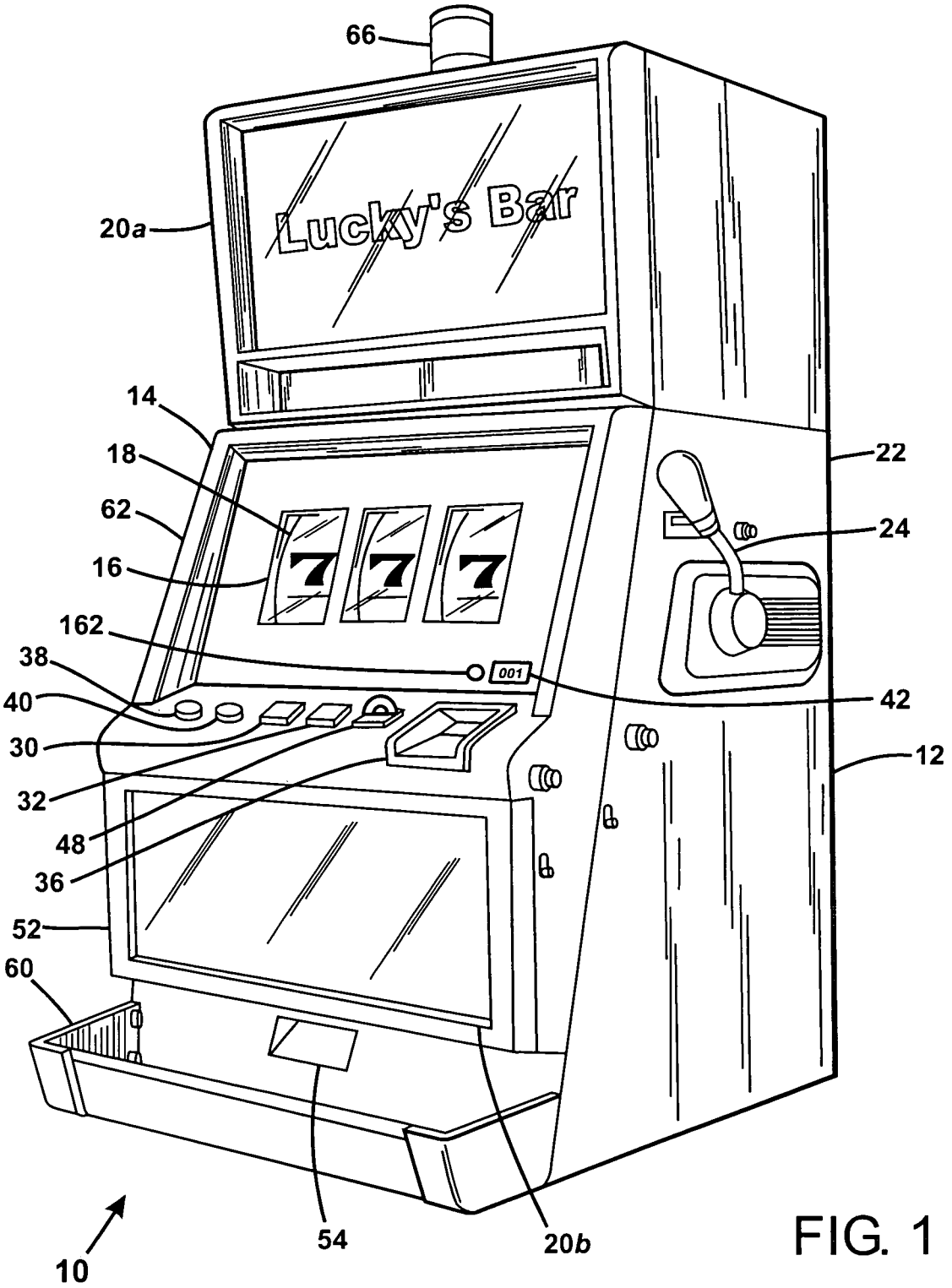
FIG. 1 is a front perspective view of the preferred embodiment of the present invention illustrating a cabinet having an access door in a closed position.

Reference is now made to FIG. 1 of the drawings illustrating a memento dispensing device 10 of one embodiment of the present invention, generally resembling in most respects to a conventional slot machine of the type appreciably known and available in the art, more or less in terms of its visual effects, controls, and general operation. A cabinet 12 constitutes the memento dispensing device in its entirety, having a front panel 14 with a plurality of divided display windows 16 for allowing select observation of images depicted on a plurality of reel wheels 18 housed within an interior compartment 12*a* of the cabinet and primary upper and lower translucent surfaces 20*a*, 20*b* for accepting and mounting therebehind advertisements or promotional offerings of an establishment. The images may consist of any one or a combination of numeric symbols, animated figures, or graphics of representative form to serve in the promotion of a product or service offered by an establishment, including but not limited to amusement or theme parks, shopping centers, eateries, and other establishments most likely to gain beneficial use of the present invention. Additionally, the cabinet 12 comprises a pair of side panels 22 one of which is made suitable for mounting thereon a spin lever 24 appropriately sufficing as an input interface device 26 to set in motion the images or symbols. Each side panel consists of a secondary translucent surface 28 for accepting and mounting therebehind advertisements and the like. It is noted herein, however, that the cabinet may comprise of alternative input interface devices for setting in motion the images, including spin and max bet switches 30, 32 accessibly mounted to the front panel 14, preferably below the divided display windows 16, and operably connected and controlled by process controller means 34 contained within the cabinet, as will be discussed hereinafter in more descriptive detail.

Also, as illustrated in FIG. 1, the front panel 14, in conjunction with the spin and max bet switches, comprises a bill insertion slot 36 for accepting therein a bill for credit reserve to initiate activation of the spin lever or switches, an attendant switch 38 for calling an attendant to the memento dispensing device 10 to address and service selective issues concerning electrical and mechanical components operably controlled by process controller means 34, and a change-out switch 40 for dispensing the residual amount of the credit reserve calculably posted on a numeric display counter 42 placed below and adjacent to the divided display windows 16.

For this particular memento dispensing device 10, a currency acceptor 44 in the form of a bill validator 46 is provided to accept money in the form of paper currency in a bill insertion slot 36, generally in common denominations of $1.00, $5.00, and $10.00. A suitable bill validator for the preferred embodiment of the present invention is the DBV-200 bill validator manufactured by JCM of Kanagawa and Osaka, Japan. The bill validator pulls in the bills, determines the denomination of the bills and determines whether the bills are valid. If a bill is invalid, it will be returned to the consumer back through a return slot incorporated in the bill validator. To the extent valid bills are inserted into the bill validator, the bill validator 46 will retain them and communicate their presence to process controller means 34. In the alternative or in addition to the bill validator, the currency acceptor 44 may be in the form of a coin acceptor 48 contemplating a coin collecting box 50 which collectively operate similarly to the bill validator in terms of collecting money in the form of coins, counting them, validating them, and storing them. Again, the information about the amount and validity of coins ascertained by the coin acceptor is communicated to process controller means 34 of the memento dispensing device. As noted for an alternative embodiment of the memento dispensing device 10, the bill validator 46 may be configured to accept credit cards as permitted by the establishment, such as a SMARTCARD™, or those offered by multinational corporations, such as VISA™, MASTERCARD™ or AMERICAN EXPRESS™.

If sufficient bills, coins or credits have been inserted into the memento dispensing device, the process controller means will permit activation of the spin lever 24 or switches 30, 32 by the operator or consumer to set in rotational motion the images depicted on the reel wheels. In the preferred embodiment, the spin and max bet switches located on the front panel 14 are illuminated and enabled by process controller means 34. As noted above, the spin and max bet switches effectively serve as alternative means of allowing the consumer or operator to set in motion the images by simply pressing downwardly on either one of them in lieu of pulling downwardly on the spin lever. The presence of other switches, such as the attendant and change-out switches 38, 40, are equally illuminated during operation of the memento dispensing device of the present invention, particularly when their functions are available for activation by the consumer or operator.

Figure 2:
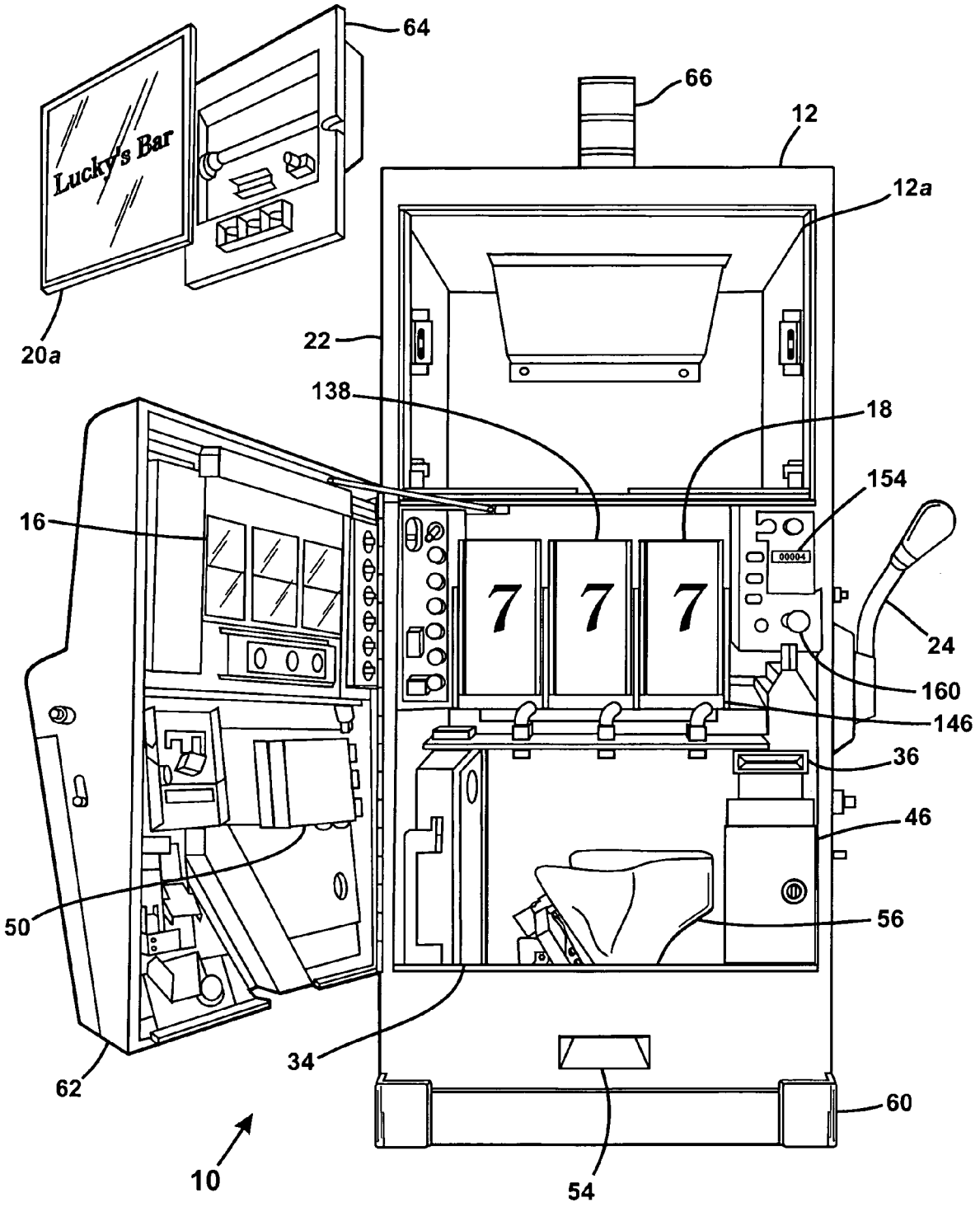
FIG. 2 is a front perspective view of the preferred embodiment of the present invention illustrating a cabinet having an access door in an open position.
Figure 3:
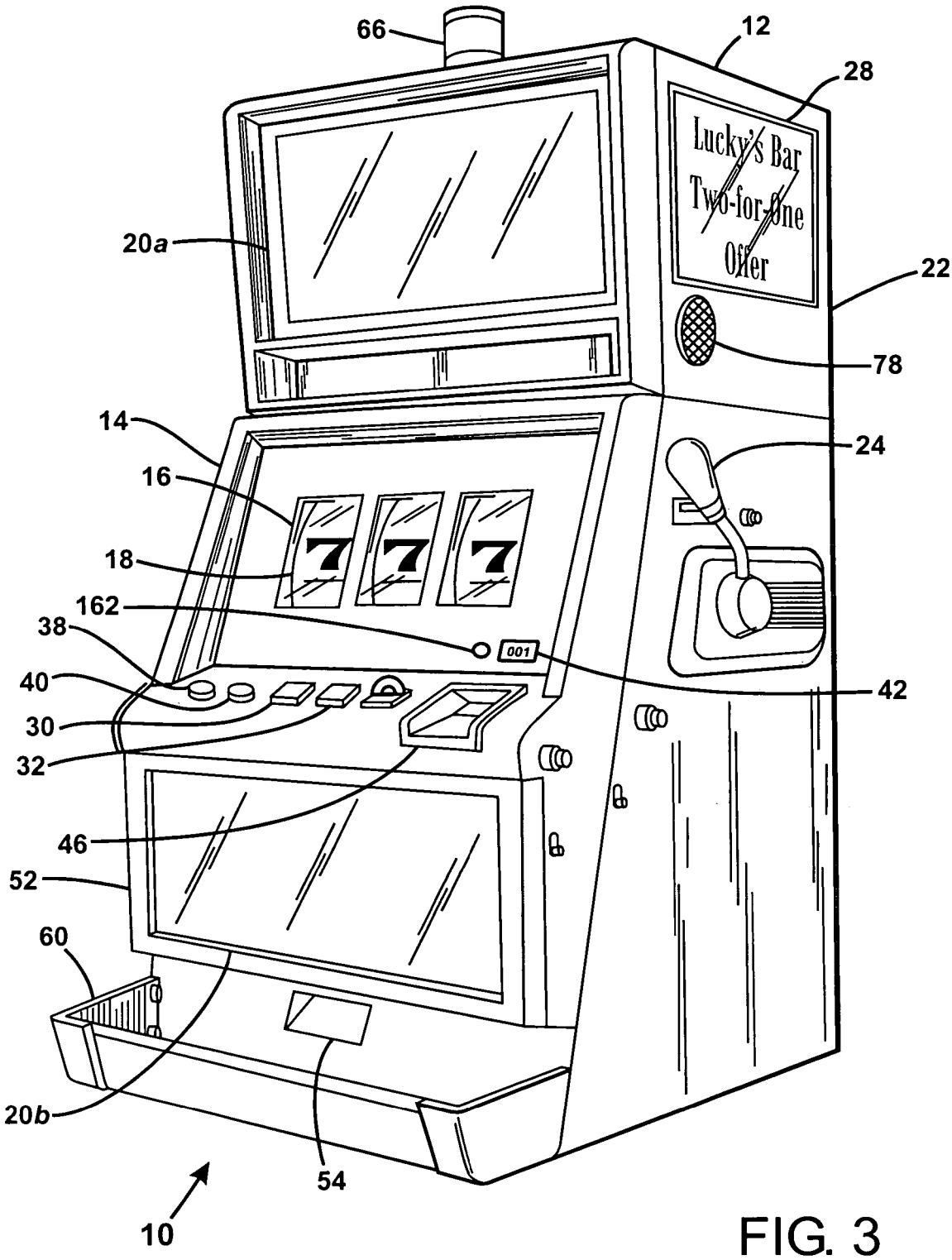
FIG. 3 is a front perspective view of the preferred embodiment of the present invention illustrating a cabinet having a monitor contained within a primary upper translucent surface for viewing by an operator.

In addition to the interactive, illuminated switches, a lower portion 52 of the front panel comprises a chute 54 for passing therethrough mementos retrieved from a memento bin or hopper assembly 56 housed within the cabinet 12 and operably controlled by process controller means 34 via a hopper controller 58. A variety of hopper devices presently known in the art may be employed in the operative capacity of dispensing mementos in the form of tokens and other commemorative objects from the memento dispensing device 10, particularly hoppers of the type manufactured by the Asahi Seiko Company, Ltd of Tokyo, Japan, notably known as the DH series. It is noted herein that hopper assemblies having a larger storage and dispensing capacity and coupled to an associated hopper controller 58 for linking with process controller means 34 may be used in the capacity for dispensing mementos in other varied forms other than for a token noted hereinbefore. A reservoir 60 mounted externally on the lower portion 52 of the front panel 14 is suitably positioned in range of and below the chute 54 to collect and store mementos as they accumulate during repeated operation of the memento dispensing device 10. As discussed above, the front panel comprises primary translucent surfaces 20 for mounting therebehind one or more decorative panels which depicts printed matter in the nature of advertisements, themes, and other promotional offerings of the establishment and an access door 62 for accessing process controller means 34 as well as other electrical and mechanical components housed within the cabinet 12. In the preferred embodiment, as depicted in FIG. 2, the decorative panel on the primary translucent surface is illuminated by a back-light fixture 64 to further the above-noted purpose, particularly to differentiate the memento dispensing device 10 from among other physical features typically found at an establishment. As shown in FIG. 1, these decorative panels may be arranged below and above the illuminated switches 30, 32 to maximize their appeal or effectiveness on the consumer as well as appearing behind the secondary translucent surface 28 of side panels 22, as shown in FIG. 3. In other operable respects, the memento dispensing device, like the conventional slot machine, comprises an illuminated candle 66 situated atop the cabinet 12 which can be activated by the consumer in the event of an observed malfunction of the memento dispensing device via the attendant switch 38 or automatically activated upon the recognition of internal error codes by process controller means 34, such as in the event of an observable tilt condition of the memento dispensing device. Accordingly, in this instance, the bill validator 46 or coin acceptor 48 will not accept any currency of recognizable denomination, thus rendering the memento dispensing device 10 inoperative, which is reassuringly apparent to the consumer by the activation of the illuminated candle 66.

Figure 4:
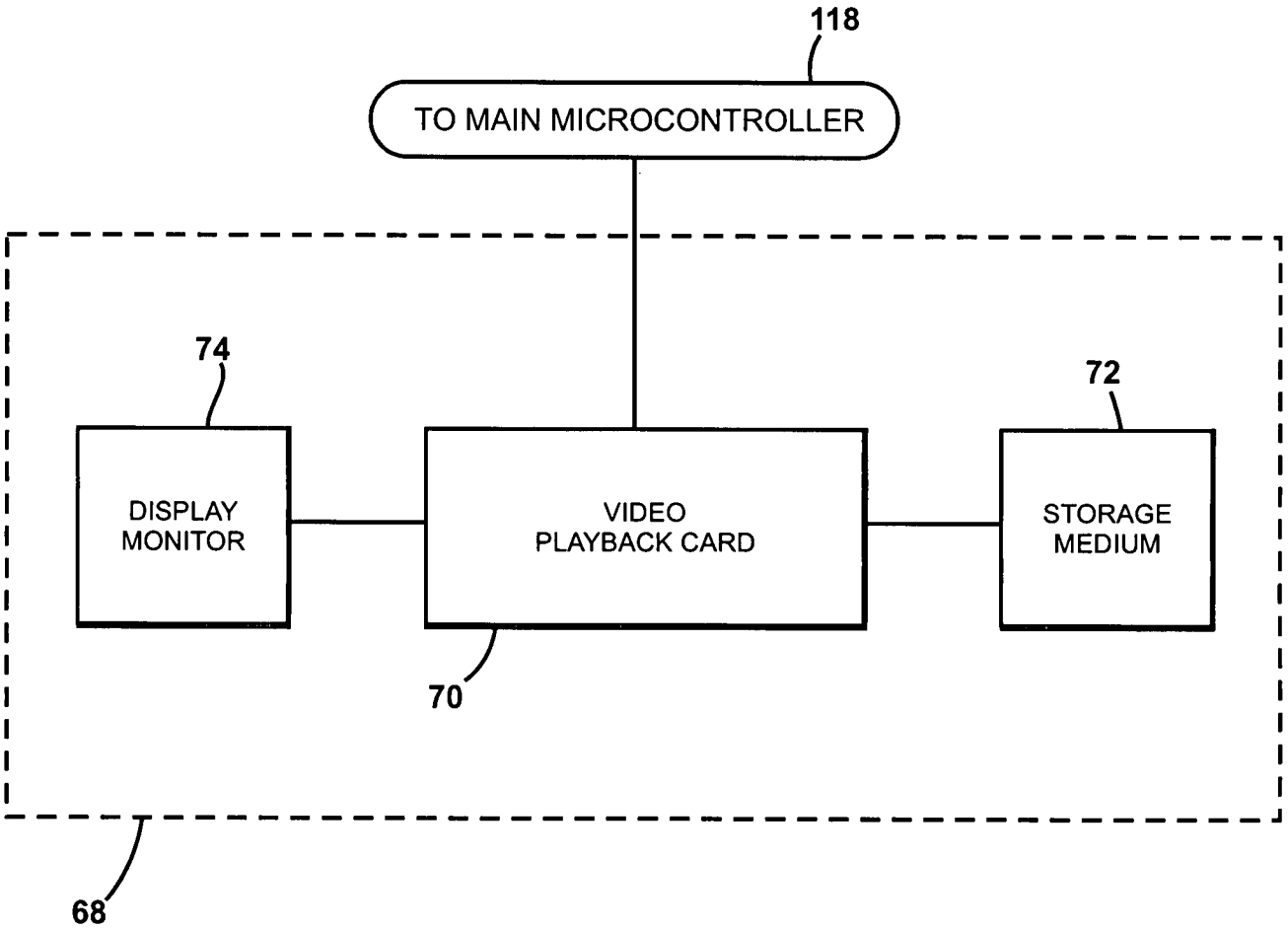
FIG. 4 is a flow chart of the preferred embodiment of the present invention illustrating means for playing back video footage on a monitor.
Figure 5:
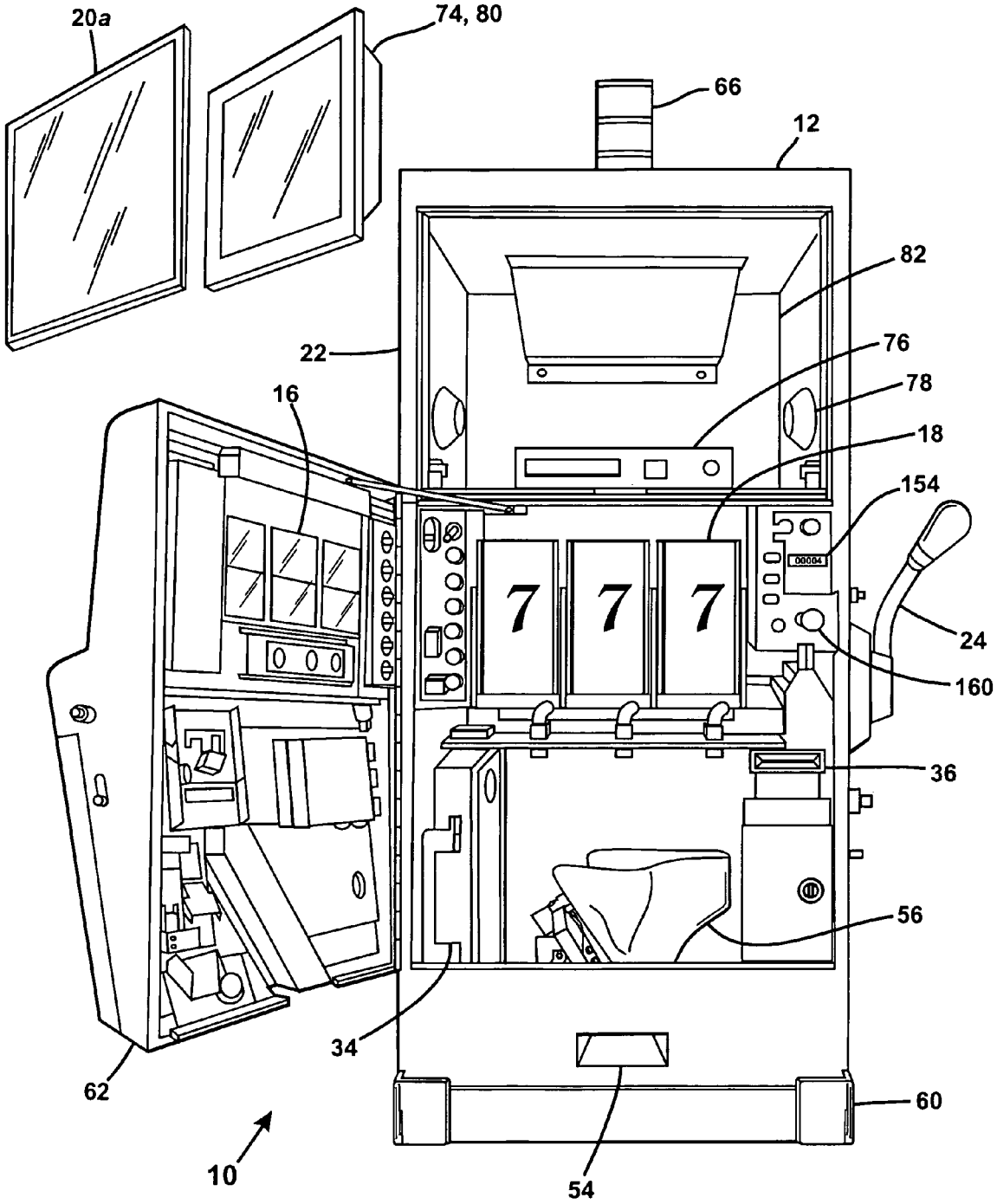
FIG. 5 is a front perspective view of the preferred embodiment of the present invention illustrating a consumer-based video playback device situated within an upper portion of a cabinet and a monitor or an all-in-one digital display device configurably arranged behind a primary upper translucent surface.
Figure 6:
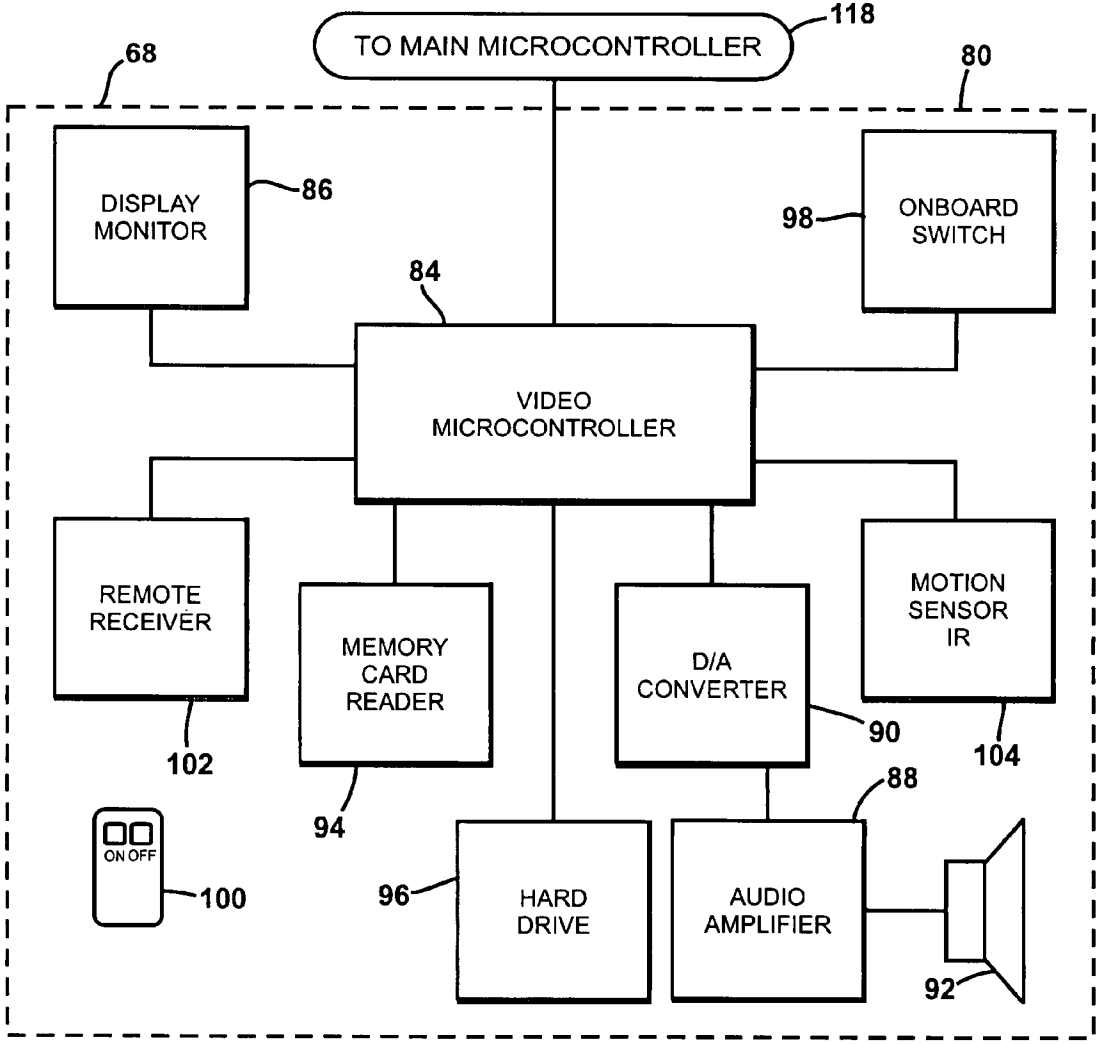
FIG. 6 is a flow chart of the preferred embodiment of the present invention illustrating components of an all-in-one digital display device coupled to a main microcontroller.

In furthering the utility of the present invention in terms of its entertaining capabilities, process controller means 34 is communicatively coupled to means for playing back video 68 footage stored in recognizable memory, substantially comprising a video playback card 70 having an inherently configured storage medium 72 such as erasable programmable read-only memory (EPROM), random access memory (RAM) or equivalent for storing video in uncompressed or compressed formats commonly employed in the art and a video monitor 74 for displaying stored video footage, as shown in FIG. 4. Suitable video monitors for this application may comprise of the type known in the art as a cathode ray tube (CRT) display, light emitting diode (LED) display, a liquid crystal display (LCD), plasma, or any other suitable display technology, substantially as configured in FIG. 5. A suitable video playback card 70 for this application which incorporates inherently configured storage medium 72 and controller functionality may be of the type commonly used in a standard consumer computer such those manufactured by Nvidia Corporation of Santa Clara, Calif. In other configurations, a consumer-based video playback device 76 may be utilized in lieu of the video playback card for continuous viewing of video footage stored on such formats as magnetic tape, compact disc, digital video discs (DVDs), or other storage media appreciably known in the art, particularly on video playback devices of the type manufactured by Panasonic Company of Osaka, Japan and Sony Corporation of Tokyo, Japan, for example. In either one of the two arrangements noted above for video playback, activation of the requisite components for video playback means 68 may occur upon first recognition of acceptable forms of currency by the bill validator 46 for which permits activation of the spin switch 30 by the operator to commence operation of the memento dispensing device 10 and continues to operate for a predetermined period of time after consummating the memento sales transaction. In other activation states, video playback means 68 may occur for a timed interval without the requisite payment of currency by the operator, such as in the instance of utilizing the consumer-based video playback device 76, which may be appropriately configured for continuous playback of video and manually controlled of its operation by personnel of the establishment for an allotted time interval rather than by process controller means 34. Audio transmission from such configuration may depend on speakers 78 coupled to appropriately configured outputs emanating from the consumer-based video playback device 76, which collectively operate independent of the circuitry for process controller means and are housed within the cabinet 12, substantially as shown in FIG. 5. Other video playback means 68, substantially similar to that incorporating a consumer-based video playback device, include an all-in-one digital display device 80 housed within an upper portion 82 of the cabinet, preferably comprising a microcontroller 84 coupled to a display monitor 86 in the form of LCD or equivalent display technology, an amplifier 88 and a digital/analog converter 90 for accepting and converting an audio signal for output to speakers 92, a memory card reader 94 capable of accessing and reading stored media on a compact flash card, including JPEG, MP3, MPEG1, and MPEG2 formats, and a hard drive 96, as substantially shown in FIG. 6. One such device suited for this application and incorporating the above featured components is Model LM1530 as specifically manufactured by Caltron Industries, Inc. of Fremont, Calif. Means available for activating the all-in-one digital display device 80 may comprise of an onboard switch 98 locally operated thereat, a remote control transmitter 100 capable of transmitting infrared (IR) signals to a receiver 102 coupled to the microcontroller 84, or a motion sensor IR 104. Conditions for operation of the all-in-one digital display may occur similarly to that described for the available means for video playback noted above, with exception where the motion sensor IR activates the all-in-one digital display device 80 in the presence and movement of an object, such as a person.

Figure 7:
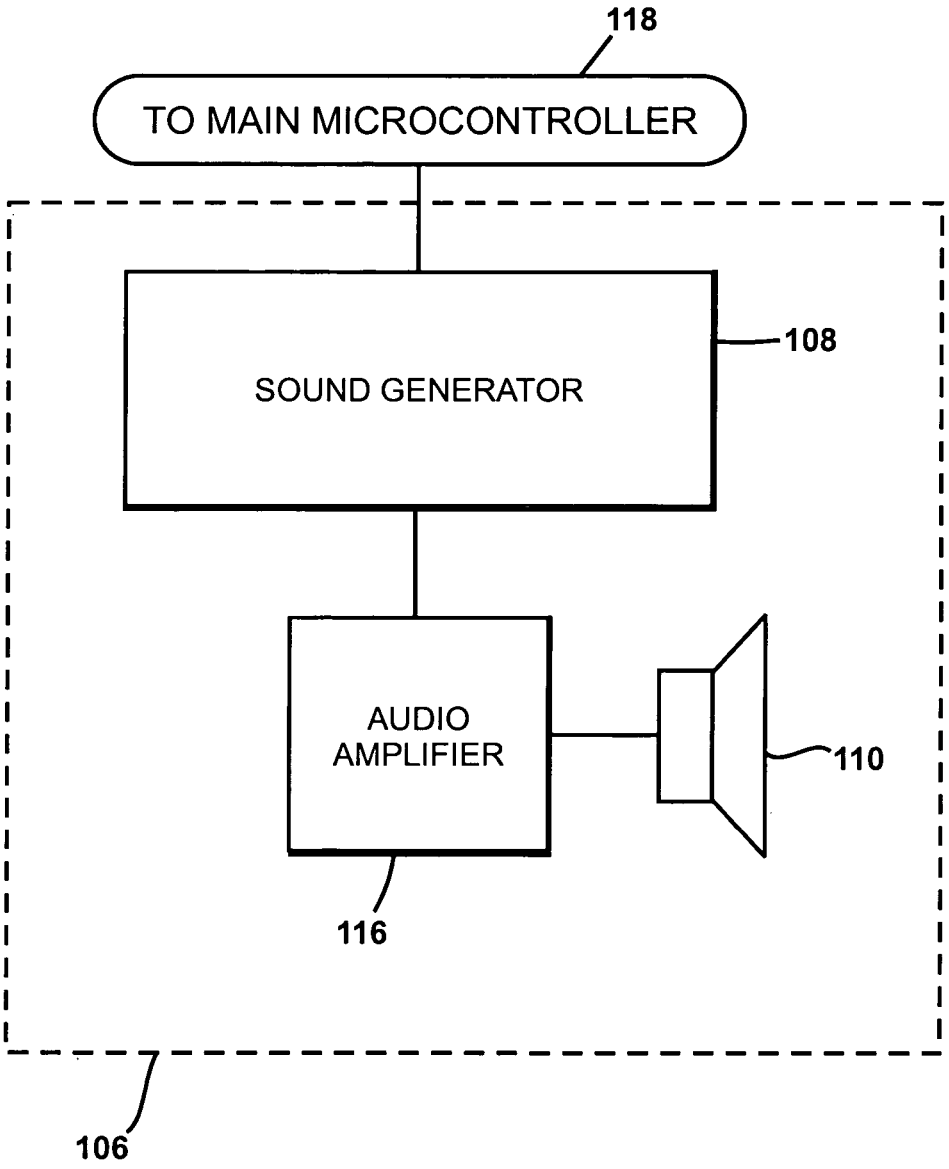
FIG. 7 is a flow chart of the preferred embodiment of the present invention illustrating a sound generator coupled to a main microcontroller.
Figure 8:
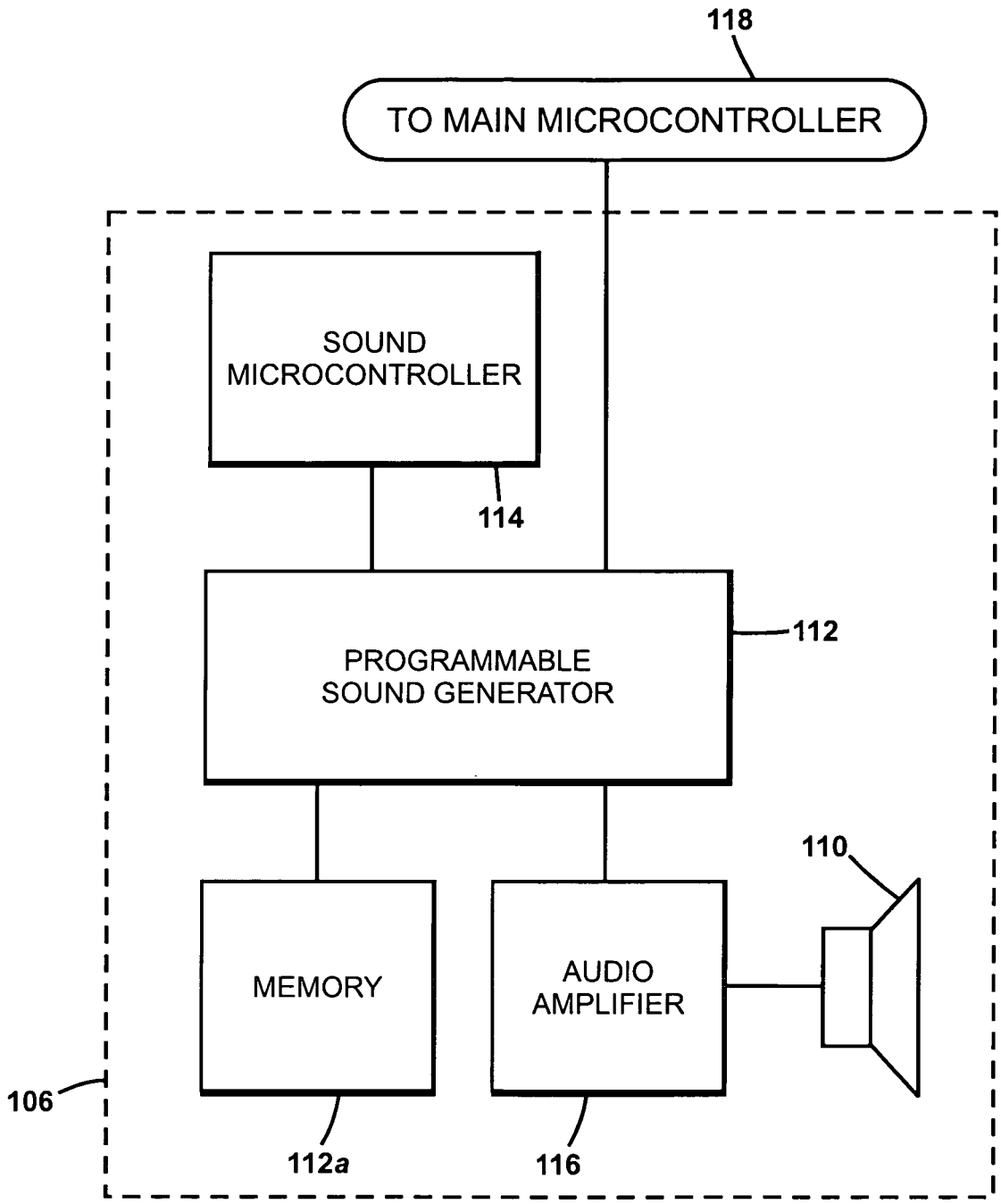
FIG. 8 is a flow chart of the preferred embodiment of the present invention illustrating a programmable sound generator coupled to a main microcontroller, memory, and a sound microcontroller.

In addition to the available means for video playback as noted above, the memento dispensing device 10, as shown in FIG. 7, further comprises means for producing digitally enhanced sound 106 from a sound generator 108 communicatively coupled to process controller means 34. Sound may emanate from a plurality of speakers 110 housed within the cabinet 12 at predetermined, timed events, such as upon the insertion of an appropriate denomination of currency in the currency acceptor 44, upon activation or stopping of the reel wheels 18, or upon dispensing a memento from the memento bin or hopper assembly 56. In the preferred embodiment of the present invention, process controller means 34 is coupled to a register orientated programmable sound generator 112, particularly bearing an integrated circuit capable of producing a wide variety of complex sounds under software control and comprising onboard memory 112*a*. In an alternative arrangement, as depicted in FIG. 8, the programmable sound generator may be configured with and supplementally controlled by a dedicated sound microcontroller 114 to alleviate computational activity of process controller means, primarily to ensure uninterrupted operation and control of other operative functions of the present invention, notably in the instance where the application program executes commands for starting and stopping the rotation of the reel wheels 18. A sound microcontroller suited for this particular purpose, specifically directed to sound production, may comprise of the type manufactured by General Instrument Corporation, noted herein as 16-bit based models CP1600/1610. Analog signal outputs from the programmable sound generator 112 are preferably coupled to an audio power amplifier 116 having a moderate supply voltage range of 8 to 22, such as model LM380 manufactured and offered by National Semiconductor Corporation of Santa Clara, Calif. Output of the audio signal as produced from the sound generator 112 is made possible by coupling the audio power amplifier outputs with an equal number of speakers 110 operating within a compatible, conforming impedance range.

Figure 9:
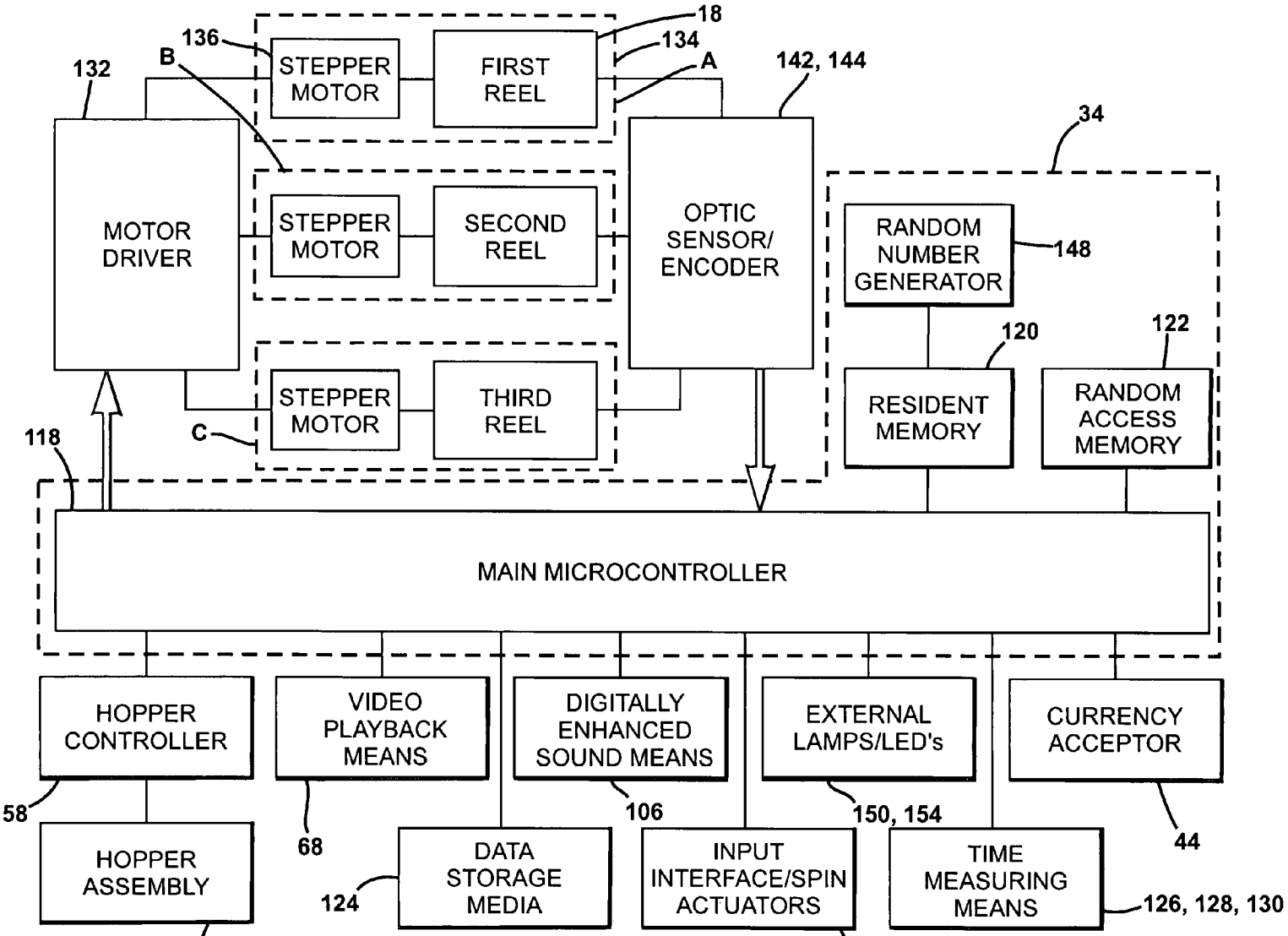
FIG. 9 is a flow chart of the preferred embodiment of the present invention illustrating a main microcontroller communicatively coupled to a resident memory module, processor memory module, at least three reel assemblies via a motor driver, a currency acceptor, hopper controller, digitally enhanced sound means, time measuring means, input interface, video playback means, and external lamps.
Figure 10:
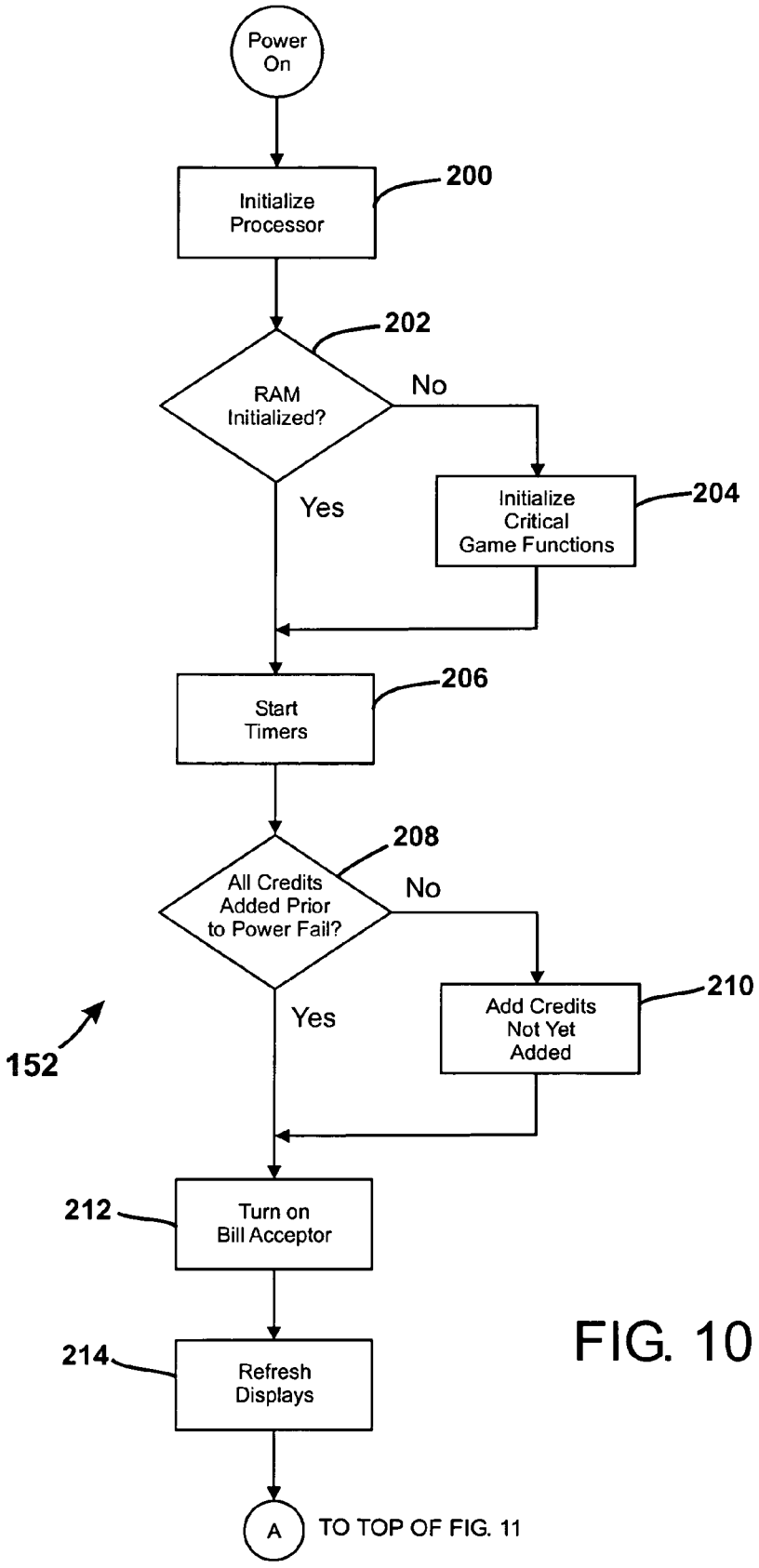
FIG. 10 is a flow chart of the preferred embodiment of the present invention illustrating an initialization routine integrally included in an application program as executed by process controller means.

FIG. 9 is a block diagram which schematically illustrates the methodology and arrangement of the logic circuitry that contains process controller means 34 for selectively controlling operation of the memento dispensing device 10 and peripheral components connectively coupled thereto, such as those components operably dedicated in setting in motion the reel wheels 18 each bearing images or symbols housed within the cabinet 12. Process controller means preferably comprises a main microcontroller 118 that executes control operations according to a preset application program, a resident memory module 120 for storing the application program, and a random access memory (RAM) module 122 suitably serving as system memory for temporary storage of input and output data accumulated during operation and operating histories, for example. Microcontrollers most suited for this application include the 68000 series manufactured by Motorola Corporation of Schaumberg, Ill. and the 8051 series manufactured by the Intel Corporation of Santa Clara, Calif. and Dallas Semiconductor of Dallas, Tex. It is noted herein that other microcontrollers 118 may equally be suited for this application providing they possess the same operating parameters and characteristics as those specifically noted for the preferred embodiment of the present invention. Those appreciably skilled in the art will also recognize that the above-noted microcontrollers are suited to cooperate and function with polling or interrupting tasking commonly associated with microcomputers to monitor in real time input and output devices communicatively coupled to the main microcontroller, specifically to interrupt the main microcontroller and accept and execute their noteworthy functionality during operation of the memento dispensing device 10. Although not shown herein in descriptive detail, it well understood in the art that the main microcontroller may be appropriately configured with a communication/data bus coupled in between communicative devices (e.g., motor driver, optic sensor, video playback means, memory, digitally enhanced sound means, etc.) illustrated in FIG. 9 to ensure unhindered data flows and timely access to memory to permit execution of commands or instruction sets set forth in the application program. Resident memory modules 120 most suited for this application may comprise of RAM, read only memory (ROM), or any combination thereof. Further, alternative forms of memory may be connectively coupled to the main microcontroller to serve or supplement in this capacity, including, for example, an erasable programmable read only memory (EPROM), an electrically erasable programmable read only memory (EEPROM), a one time programmable read only memory (OTP ROM), a static random access memory (SRAM), FLASH or an equivalent form of memory appreciably known in the art. Additionally, data storage media 124 may be connectively coupled to the main microcontroller 118 to supplement in its functionality in this regard, including by way of example magnetic media (e.g., hard disk, floppy disks and the like) or optical media (e.g., compact disks, digital video disks and the like).

As will be appreciated by those having ordinary skill in the art, the set of instructions included in the application program for executing the functions of the memento dispensing device 10 may be written in any suitable high level computer language, such as, for example, C or C++, and compiled into a suitable form for storage in the resident memory module 120 for later execution by the main microcontroller. Alternatively, the instruction set may be written in assembly or machine language form and compiled into a suitable form for storage in the resident memory module.

As further illustrated in FIG. 3, the main microcontroller of process controller means 34 is further operatively connected to means for measuring time 126 such as a real time clock or timer 128 which can be set, reset and read by the main microcontroller 118 to measure the passage of time. This real time clock is advantageous in generating operating histories for storage in RAM or transmission through a network communication or to assist the main microcontroller in generating random numbers by tying the random number generation algorithm to a time reference such as the time of day. A suitable real time clock for the memento dispensing device 10 would be a 2K non-volatile "Dallas Timekeeper" RAM produced by Dallas Semiconductor of Dallas, Tex. Alternatively, the main microcontroller 118 may utilize signals or pulses generated by a clock pulse generator 130 to measure the passage of time in lieu of the real time clock, as will be apparent to one of ordinary skill in the art, or for generating reference pulses of 4 MHz, for example, at which the main microcontroller is operated.

Rotational movement of the reel wheels 18 housed within the cabinet 12 is substantially controlled by the communicative interaction of the main microcontroller and a motor driver 132 connectively coupled to at least three reel assemblies 134. Each reel assembly, as denoted by blocks A, B, and C in FIG. 9, comprises a stepper motor 136 suitably serving as a main actuator for rotatably driving the reel wheel bearing on its circumferential periphery a reel strip 138 affixed with a plurality of images or symbols 140, such as the number "7" shown in FIG. 1. Stepper motors most suited for this application may be of the type manufactured by the Minebea Co., LTD of Tokyo, Japan, specifically being identified herein as an ASTROSYN Miniangle Stepper type motor bearing model number 34PM-C007-14. Alternatively, as will be appreciated by those having ordinary skill in the art, other types of stepper motors 136 may be utilized in this capacity providing they operate and function in like manner as the one designated for the preferred embodiment. Alternatively, rather than using a number of stepper motors to spin the reel wheels 18, a single motor may be utilized for simultaneous rotation of the reel wheels. Further, each of the reel wheel assemblies 134 may comprise an associated encoder 142 that assists in sensing the rotational position of the reel wheel and ensures proper display of the pre-select image or symbol in the divided display window 16.

As will be readily appreciated by those having ordinary skill in the art, while the reel wheels may be physical reels that spin, the reel wheels may alternatively be embodied in virtual reel wheels that are generated and controlled by instructive commands preferentially of which are incorporated into the application program residing in resident memory and executed by process controller means. It is contemplated that this embodiment may further comprise a plurality of virtual symbols or images which appear to reside on the circumferential periphery of the virtual reel wheel, substantially appearing to the likes of the physical reel wheel described herein, and move with the simulated movement of the virtual reel wheel. Electronic display technology such as, for example, a light emitting diode (LED) display, a liquid crystal display (LCD) or any other suitable display technology may supplement this alternative embodiment to permit observation of the virtual reel wheels and associated symbols.

In the preferred embodiment of the present invention, each reel strip 138 comprises 22 images or symbols that are equally divided thereabout for circumferential positioning on the reel wheel 18. In association with each image or symbol is a physical stop which is symbolically represented in the application program to denote the stopping position of each reel wheel and display accordingly the appropriate image through the divided display window 16 in such manner that correlates with the operating parameters or conditions of the application program. Each stepper motor 136 of the present invention is capable of providing 400 steps or pulses per complete revolution of the reel wheel. Reel wheel position and speed is monitored by process controller means 34 via an optic sensor 144 that is mounted on a reel wheel bracket assembly 146 used in supporting the reel wheels. The optic sensor in this operative capacity signals process controller means that upon optic interruption after a predetermined time interval, the reel wheel is at reference point zero or at a home flagged position. After recognition of the home flagged position, the application program instructs each reel wheel to its randomly selected stop position via process controller means 34 communicatively coupled to the motor driver 132 and stepper motor. The manner in which each reel wheel stops at its final position is principally established by the communicative interaction of process controller means and a random number generator 148 integrally included as part of the application program. In FIG. 9, the random number generator is shown apart from the application program in resident memory 120 to illustrate its relationship and capability to function with process controller means 34. In its operative capacity, the random number generator generates a random number through utilization of a random number generation algorithm and a numeric seed value, which may be substantially based on a numeric value taken from the real time clock 128 as suggested above. In the instance of the present invention, a random number is generated for each of the reel wheels in the manner noted above, particularly within a predetermined time period after the spin lever 24 or spin or max bet switches 30, 32 has been activated by the operator or consumer. The random number is then evaluated in accord with the instruction set provided in the application program, with the resultant figure serving as a basis for conducting and completing a reel spin cycle. The application program in particular assigns a case outcome based on the selected random number to command process controller means 34 to deliver to each stepper motor via the motor driver 132 a predetermined number of pulses or steps beyond the home flagged position to display accordingly a pre-select image or symbol in the divided display window 16. In illustrating the preferred embodiment of the present invention in terms of its above-noted functionality, the random number generator 148 may compute a random number from a numeric seed value based on a time reference that is algorithmically reduced to a numeric value falling within a predetermined range of numerical values for the total number of stop positions, such as in an exemplified case of a reduced numeric value of 185 falling within a predetermined range of numerical values extending from zero to 2199. The application program then evaluates this reduced numeric value in terms of its absolute value falling within a sub-numeric range pre-selected for each of the reel wheel stop positions operatively associated with an image or symbol. TABLE 1 illustrates a typical mapping scheme for 22 images or symbols appearing on a reel strip 138 affixed to a reel wheel 18 and coinciding with 22 reel wheel stop positions.

TABLE 1

| Case Outcome | Reel Wheel Stop Position | Image Displayed | Sub-numeric Range | Number of Steps or Pulses |
|---|---|---|---|---|
| 1 | 0 | Image A | 0–99 | 0 |
| 2 | 1 | Image B | 100–199 | 18 |
| 3 | 2 | Image C | 200–299 | 36 |
| 4 | 3 | Image D | 300–399 | 54 + 1 |
| 5 | 4 | Image E | 400–499 | 73 |
| 6 | 5 | Image F | 500–599 | 91 |
| 7 | 6 | Image G | 600–699 | 109 |
| 8 | 7 | Image H | 700–799 | 127 + 1 |
| 9 | 8 | Image I | 800–899 | 146 |
| 10 | 9 | Image J | 900–999 | 164 |
| 11 | 10 | Image K | 1000–1099 | 182 |
| 12 | 11 | Image L | 1100–1199 | 200 + 1 |
| 13 | 12 | Image M | 1200–1299 | 219 |
| 14 | 13 | Image N | 1300–1399 | 237 |

TABLE 1-continued

| Case Outcome | Reel Wheel Stop Position | Image Displayed | Sub-numeric Range | Number of Steps or Pulses |
|---|---|---|---|---|
| 15 | 14 | Image O | 1400–1499 | 255 |
| 16 | 15 | Image P | 1500–1599 | 273 + 1 |
| 17 | 16 | Image Q | 1600–1699 | 292 |
| 18 | 17 | Image R | 1700–1799 | 310 |
| 19 | 18 | Image S | 1800–1899 | 328 |
| 20 | 19 | Image T | 1900–1999 | 346 + 1 |
| 21 | 20 | Image U | 2000–2099 | 365 |
| 22 | 21 | Image V | 2100–2199 | 383 |

Using the mapping data provided in TABLE 1, the reduced numeric value of 185, for example, falls within the sub-numeric range of 100-199, which equates to a case outcome of two. Accordingly, in this example, process controller means 34 commands the stepper motor 136 via the motor driver 132 to rotate the reel wheel 18 steps beyond the home flagged position, particularly after the optic sensor 144 has referenced its location, to the extent that the reel wheel is situated at position one for display of Image B through the divided display window 16.

As the reel wheels collectively spin for a timed interval, the memento dispensing device 10 selects random numbers that will be used to stop each of the reel wheels at a particular position in the manner described above. Typically, the collection of reel wheels is stopped in sequence from left to right from the perspective of the operator. For example, conventionally, the first reel wheel would be stopped first, followed by the middle reel wheel and the last reel wheel positioned on the far right side. As the reel wheels 18 are stopped, symbols representative of the case outcome, which are disposed on the circumferential periphery of the reel wheel, are displayed to the operator or consumer through the divided display windows. Regardless of the image or symbol arrangement displayed in the divided display windows 16, notably after the steps or pulses have been delivered to each stepper motor and each of the reel wheels has stopped as commanded by process controller means, the memento dispensing device dispenses the commemorative memento.

In lieu of the case outcome methodology set forth above for the preferred embodiment of the present invention, an alternative second embodiment utilizes a two dimensional array suitably serving as means for setting each of the reel wheels 18 at a stopped position. In this alternative embodiment, the application program derives a numeric value representative of a case outcome from the two dimensional array in a predetermined manner and communicates the resultant value to process controller means 34 to deliver to each stepper motor via the motor driver 132 a predetermined number of pulses or steps for rotation of the reel wheel beyond the home position after it has been appropriately flagged by the optic sensor 144. The number of steps for each case outcome is derived substantially from the size of each reel wheel position, computed accordingly from the number of steps each stepper motor operates to complete full rotation (e.g., a 400 stepped motor) divided by a circumferential field of 22 stop positions (0-21). The methodology of reel wheel rotation and stoppage occurs in similar manner as provided for the preferred embodiment but without the randomness as associated with the use of the random number generator 148. In this instance, the application program's execution of each case outcome for each set of the reel wheels 18 occurs in sequence from the first stop position (at 0) to the last stop position (at 21), which correlates to the total number images on the reel wheel (i.e., 22), and transmits the resultant value of the number steps for each case outcome to process controller means 34 to command each of the stepper motors to rotate and stop each of the reel wheels in succession from left to right for completion of the spin cycle as hereinbefore described. For example, as provided in TABLE 2, the first case outcome for reel wheels one, two and three is based on the first stop position (at 0) corresponding to a pre-defined set of images (Image A, Image A, Image A) depicted on the periphery of each reel wheel. Similarly, the second case outcome for reel wheels one, two and three is based on the second stop position (at 1) corresponding to a predefined set of images (Image B, Image B, Image B) depicted on the periphery of each reel wheel. Succeeding case outcomes therefore will occur in numeric sequence up until reel position 21 is reached, after which time the process for determining case outcomes restarts at case outcome one, reel position zero. In this embodiment, each case outcome for the set of reel wheels is predictable and always coincides with a pre-defined selection, matched set of symbols or images 140. In other words, the operator is permitted to always observe a set of images or symbols to what is generally perceived as a winning combination in most gaming slot machines of chance, such as those which horizontally or angularly display a combination of three numeric symbols of seven (i.e., "7," "7," "7") or equivalent, as shown in FIG. 1. Hence, a variety of perceived-winning combinations is displayed after each and every time the set of reel wheels completes a spin cycle. TABLE 2 illustrates a typical mapping scheme for each case outcome and related stopped position for a set of reel wheels 18 of the alternative second embodiment of the present invention.

TABLE 2

| Case Outcome | Reel Wheel Stop Position | Reel Wheel One | Reel Wheel Two | Reel Wheel Three | Number of Steps or Pulses |
|---|---|---|---|---|---|
| 1 | 0 | Image A | Image A | Image A | 9.1 |
| 2 | 1 | Image B | Image B | Image B | 27.3 |
| 3 | 2 | Image C | Image C | Image C | 45.4 |
| 4 | 3 | Image D | Image D | Image D | 63.6 |
| 5 | 4 | Image E | Image E | Image E | 81.8 |
| 6 | 5 | Image F | Image F | Image F | 100.0 |
| 7 | 6 | Image G | Image G | Image G | 118.2 |
| 8 | 7 | Image H | Image H | Image H | 136.4 |
| 9 | 8 | Image I | Image I | Image I | 154.5 |
| 10 | 9 | Image J | Image J | Image J | 172.7 |
| 11 | 10 | Image K | Image K | Image K | 190.9 |
| 12 | 11 | Image L | Image L | Image L | 209.1 |
| 13 | 12 | Image M | Image M | Image M | 227.3 |
| 14 | 13 | Image N | Image N | Image N | 245.4 |
| 15 | 14 | Image O | Image O | Image O | 263.6 |
| 16 | 15 | Image P | Image P | Image P | 281.8 |
| 17 | 16 | Image Q | Image Q | Image Q | 300.0 |
| 18 | 17 | Image R | Image R | Image R | 318.2 |
| 19 | 18 | Image S | Image S | Image S | 336.3 |
| 20 | 19 | Image T | Image T | Image T | 354.5 |
| 21 | 20 | Image U | Image U | Image U | 372.7 |
| 22 | 21 | Image V | Image V | Image V | 390.9 |

Although TABLE 2 shows a set of three reel wheels 18 having matching images for each case outcome, it is noted herein that other embodiments employing usage of more than three reel wheels may comprise a set of matching and non-matching images or symbols. For instance, a case outcome for a five-reel wheel assembly may show through the divided display windows 16 three matching images contemplating a winning combination while the remaining two reel wheels appear to comprise non-matching images.

In other arrangements, the methodology for reel wheel rotation and stoppage as described for the preferred and second alternative embodiments may be incorporated into a third alternative embodiment where the random number generator 148 selects at random a case outcome from one of the 22 stop positions, and utilizes this value in the application program to compute the number of steps for each of the stepper motors to complete a reel wheel spin cycle, substantially in like manner described for the preferred embodiment. In other words, the third alternative embodiment comprises means for selecting at random each case outcome rather than in sequence as provided for the second alternative embodiment. In either of the two alternative embodiments, whereupon the reel wheels 18 have appreciably stopped in accord with the instruction set in the application program and after expiration of a predetermined time interval, process controller means 34 activates associated and communicatively coupled devices, including added illumination from external lamps 150 and audio from digitally enhanced sound means 106 to signify a perceived winning combination, activation of the hopper controller 58 for directing the dispensing of a memento from the memento bin or hopper assembly 56, and in some instances, activation video playback means 68 for displaying supplemental video footage (e.g., sporting events of commemorative value or advertisements) on the CRT- or LCD-based monitor 74 to further promote the establishment's purpose, as substantially described above.

Referring now to FIG. 4, which depicts an initialization routine 152 of the application program, in the beginning when the power supply of the memento dispensing device 10 is powered up, the main microcontroller 118 is initialized in step 200 followed by a decisional prompt at step 202 to determine the status of onboard RAM. If RAM has not been initialized as provided for at step 202, critical game functions in RAM are initialized at step 204, such as clearing previous operative conditions and updating game functions as needed for subsequent operation, particularly the clearing of tilt and internal error codes and updating a LED meter 154 for display of error codes and the like. In step 206, after initialization of the main microcontroller 118 and RAM, the real clock or timer 128 is activated to serve as a basis for timed events provided and required of execution in the application program, such as numeric seed value inputs into the random number generation algorithm and activation of internal interrupts or polling at predetermined time intervals of input and output devices that may adversely impact the main microcontroller's ability to execute directive commands provided in the application program as well as serving as means for documenting events on a timed basis or establishing operating histories for undertaking possible diagnostic activities. At step 208, the initialization routine further comprises a decisional prompt to determine the status of credits added prior to a power failure, primarily occurring upon a recognizable tilt condition to cause the memento dispensing device 10 to momentarily shut down until cleared by an attendant. If credits have not been added after such event or a return of currency is not made to the operator or consumer, the initialization routine 152 is further evaluated by a command at step 210 for the addition of credits to preserve the previous state or operating conditions if in the event the memento dispensing device becomes inadvertently inoperable as a result of a tilt condition or presence of a timed internal interrupt. At steps 212 and 214, the currency acceptor 44 is activated followed by the display or LED meter 154 being refreshed of previous operating conditions. After completing or satisfying the conditions in the initialization routine, evaluation of a predetermined number of conditional states is made in a conditional state routine 156.

Figure 11:
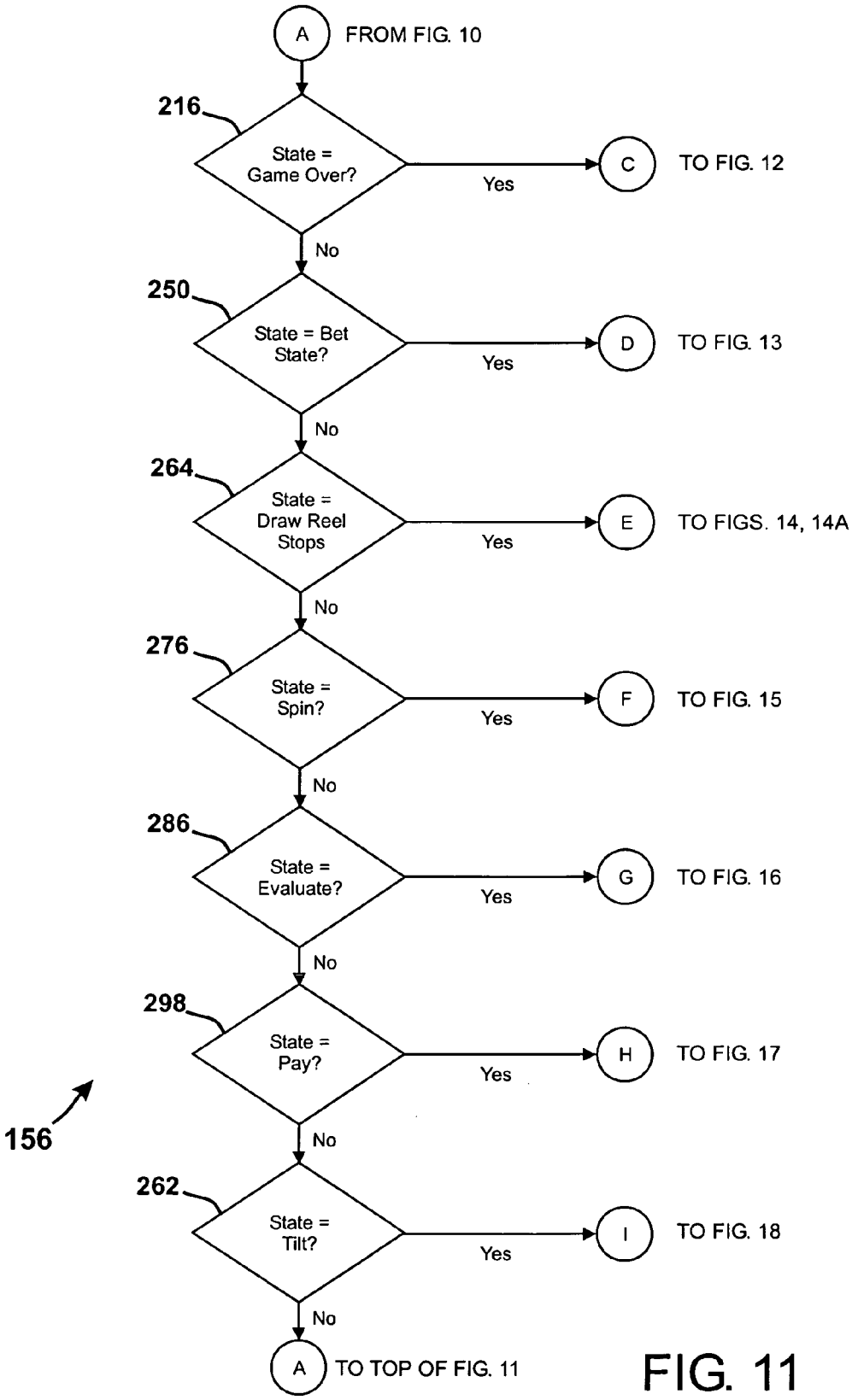
FIG. 11 is a flow chart of the preferred embodiment of the present invention illustrating a conditional state routine integrally included in an application program as executed by process controller means.
Figure 12:
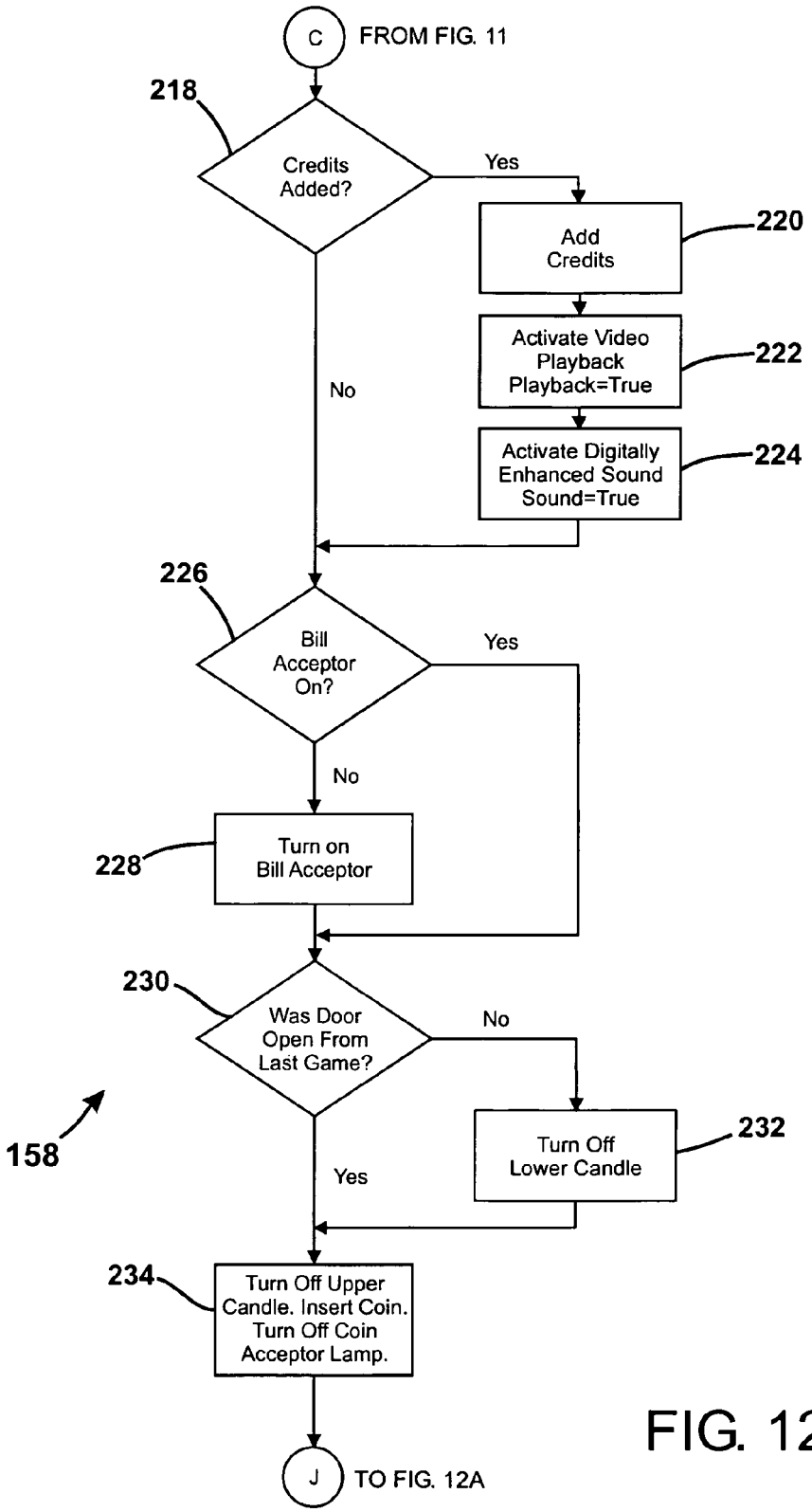
FIG. 12 is a flow chart of the preferred embodiment of the present invention illustrating a game over state sub-routine of conditional state routine in FIG. 11.
Figure 12A:
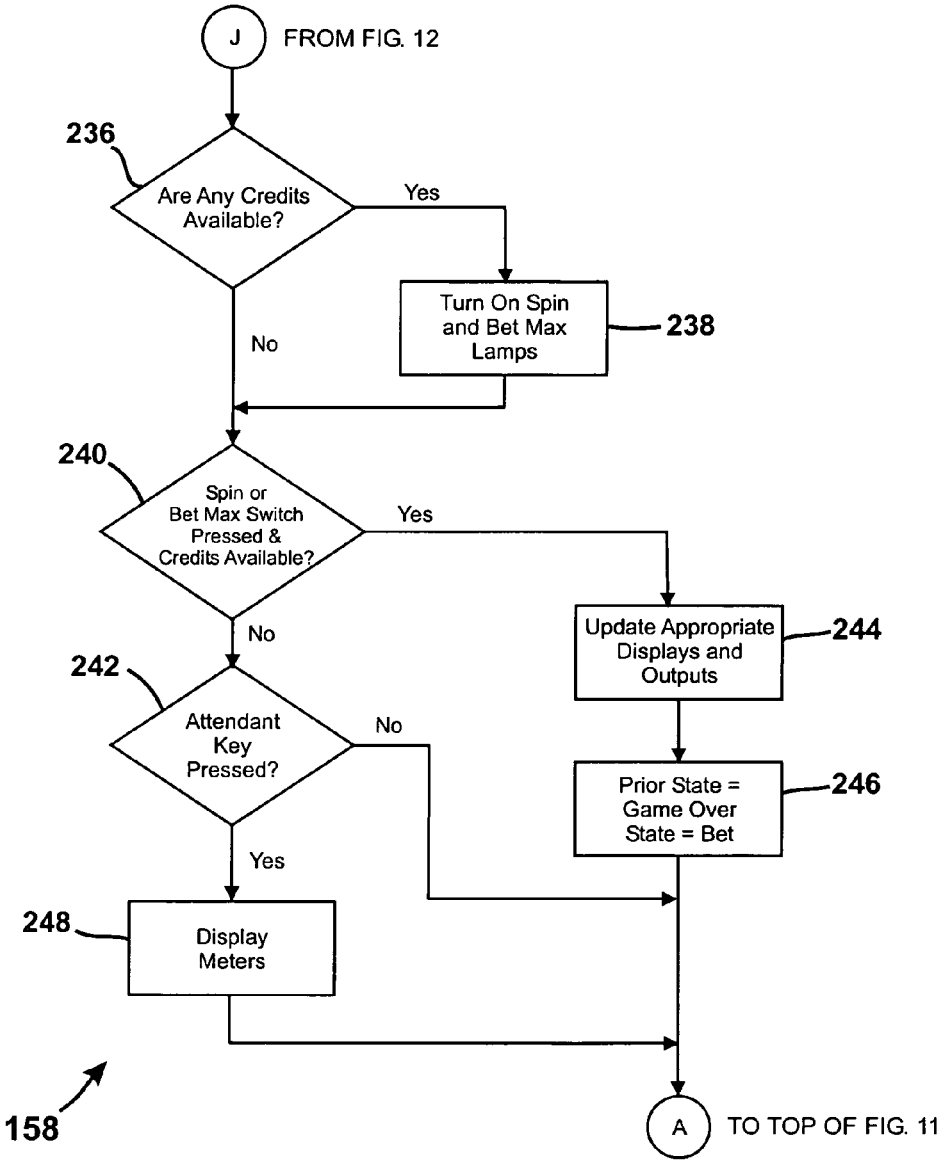
FIG. 12A is a flow chart of the preferred embodiment of the present invention illustrating continuation of the game over state sub-routine in FIG. 12.

In FIG. 11, the conditional state routine is initially evaluated by a decisional prompt at step 216 to determine and evaluate a game over state sub-routine 158. In FIG. 12, the game over state sub-routine is initially evaluated by a decisional prompt at step 218 to determine the addition of credits from previous play or operation of the memento dispensing device 10. If so, at step 220, credits are added based on the amount the consumer or operator has provided initially in the currency acceptor 44 less the amount of credit from a previous play or operation. In alternative embodiments of the present invention, video playback means 68 is activated at step 222 to display on an associated monitor pre-selected video footage stored in local memory, hard drive, disc, or magnetic media upon the addition of credits accumulated during operation of the memento dispensing device 10. Simultaneously occurring with activation of video playback means digitally enhanced sound means 106 is activated at step 224. A decisional prompt at step 226 determines whether the currency acceptor 44 is available to accept currency for operation. If available or if currency acceptor is not on, the currency acceptor is activated at step 228, and if not available because of a known tilt condition, the currency acceptor is delayed in becoming operative until such time a tilt condition or error code is cleared from memory, generally by the act of the attendant in opening and closing the access door to activate a reset momentary switch 160 communicatively coupled to the main microcontroller. At step 230, the game over state sub-routine 158 is further evaluated by a decisional prompt to determine the status of the door's position from previous operation, and if closed from previous operation, a lower lighted portion of the illuminated candle is inactivated at step 232. If the access door was open from previous operation, the game over state sub-routine at step 234 deactivates an upper lighted portion of the candle 66 and permits insertion of currency into the currency acceptor 44 for play or operation followed by the command to deactivate a coin accepted lamp 162 integrally made part of the front panel 14 for displaying to the operator or consumer the status of accepted currency. At step 236, in FIG. 12A, the game over state sub-routine 158 further comprises a decisional prompt to determine the status of credits, and if available, the spin and bet max switches 30, 32 at step 238 are illuminated to signify their availability for activation. After activation of the lamps for the bet one and bet max switches or if no credits are available, the game over state sub-routine is further evaluated by a decisional prompt at step 240 in FIG. 12A to determine the status of activating the spin and bet max switches, and if neither is activated, a further decisional prompt is provided at step 242 to determine the status of the attendant switch 38 being activated by the operator. If either the spin or bet max switches has been activated, the display or LED meter 154 is updated at step 244 to reflect the amount of accepted currency followed by the command at step 246 to re-assign the game over state to bet followed by further evaluation of succeeding instructive sub-routines in the conditional state routine 156. If the attendant switch has been activated, as provided for at step 242, a command at step 248 displays accounting meters.

Figure 13:
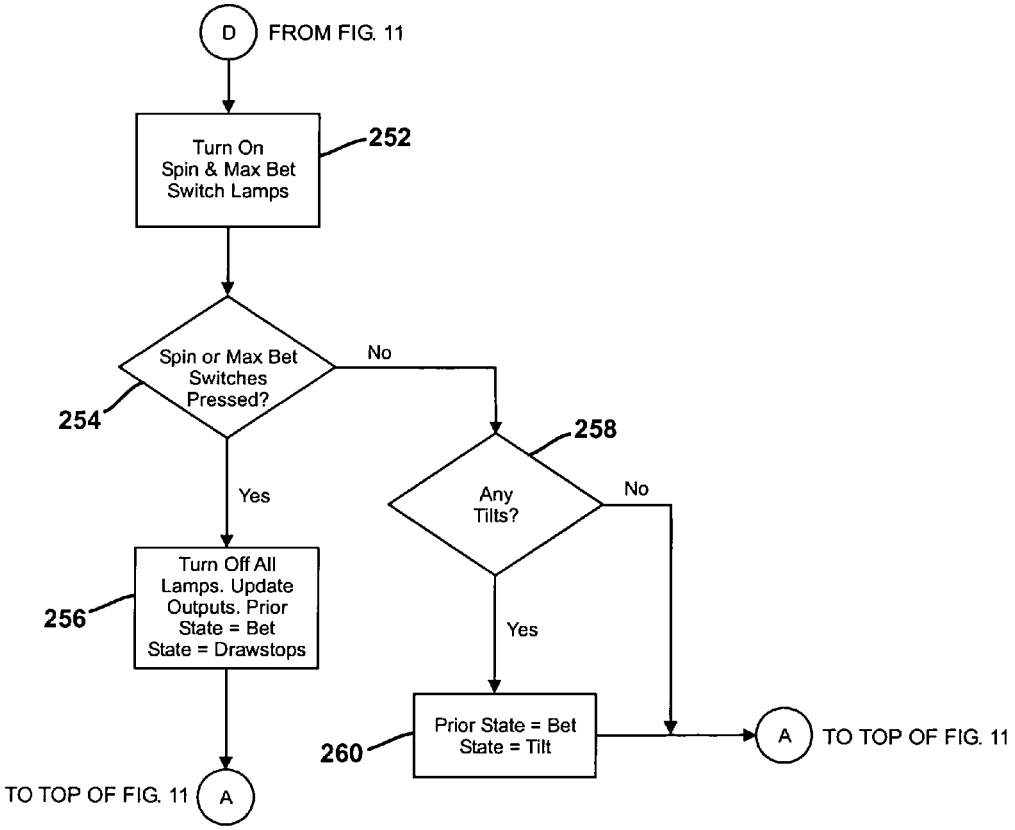
FIG. 13 is a flow chart of the preferred embodiment of the present invention illustrating a bet state sub-routine of conditional state routine in FIG. 11.

In FIG. 11, the conditional state routine 156 further comprises a decisional prompt at step 250 to determine and evaluate a bet state sub-routine 164 upon completing or satisfying the conditions set forth in the game over state sub-routine 158 prompted at step 216. In FIG. 13, at step 252, the bet state sub-routine initially commands the main microcontroller 118 to activate a lamp to illuminate the spin and max bet switches 30, 32 to make it known to the operator that the switches are available for activation to start the reel spin cycle. At step 254, the bet state sub-routine 164 is further evaluated by a decisional prompt to determine the status of activation of the spin or max bet switches, and if so, at step 256, the spin and max bet switches are deactivated of illumination; all outputs are updated; and the bet state sub-routine is re-assigned to a draw reel stops state sub-routine 166. If the spin and max bet switches have not been activated at step 254, then the bet state sub-routine 164 is further evaluated by a decisional prompt at step 258 to determine the presence of any tilt condition, and if present, the bet state sub-routine at step 260 is re-assigned to a tilt state sub-routine 168 at step 262 in the conditional state routine 156 for evaluation of conditions set forth therein to determine the cause of internal errors attributing to the memento dispensing device's unavailability to operate. If no tilt conditions are present, the bet state sub-routine 164 continues to be evaluated in like manner after step 256.

Figure 14:
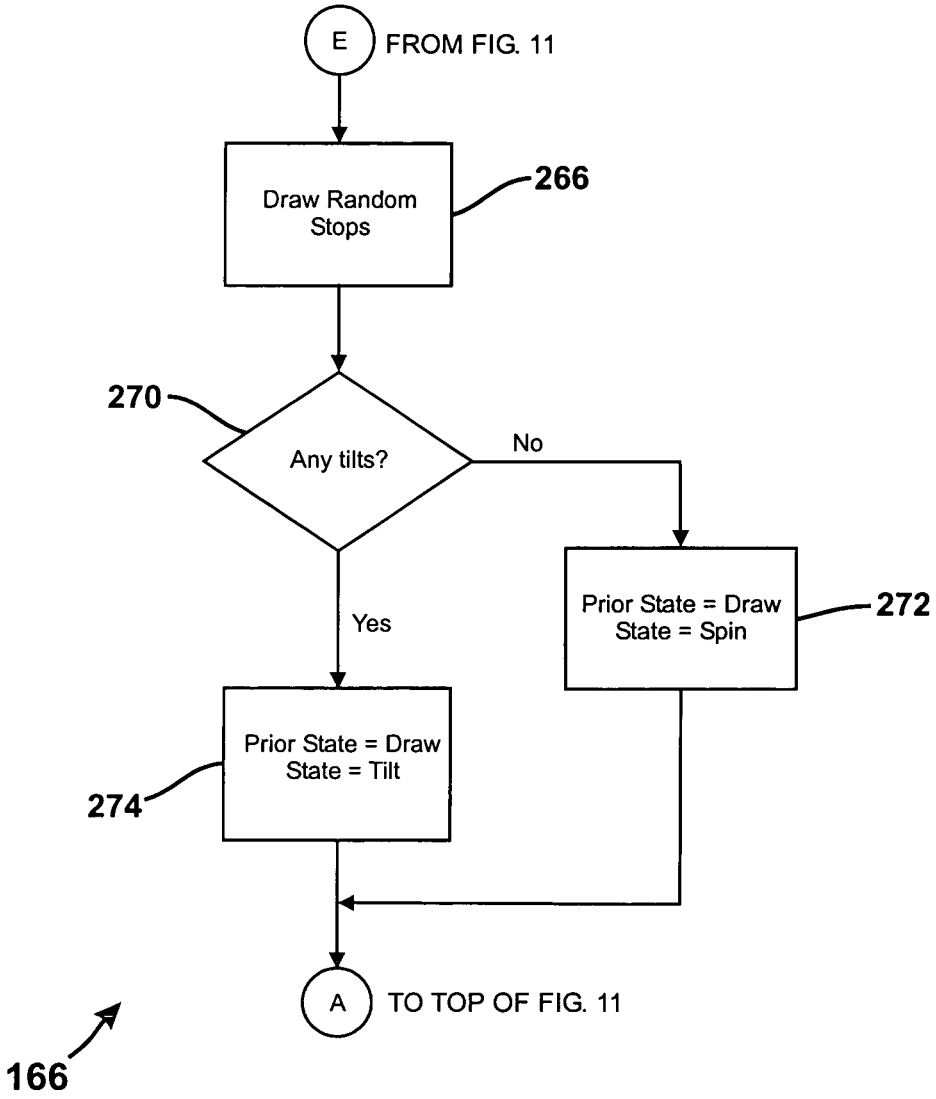
FIG. 14 is a flow chart of the preferred embodiment of the present invention illustrating a draw reel stops state sub-routine of conditional state routine in FIG. 11.
Figure 14A:
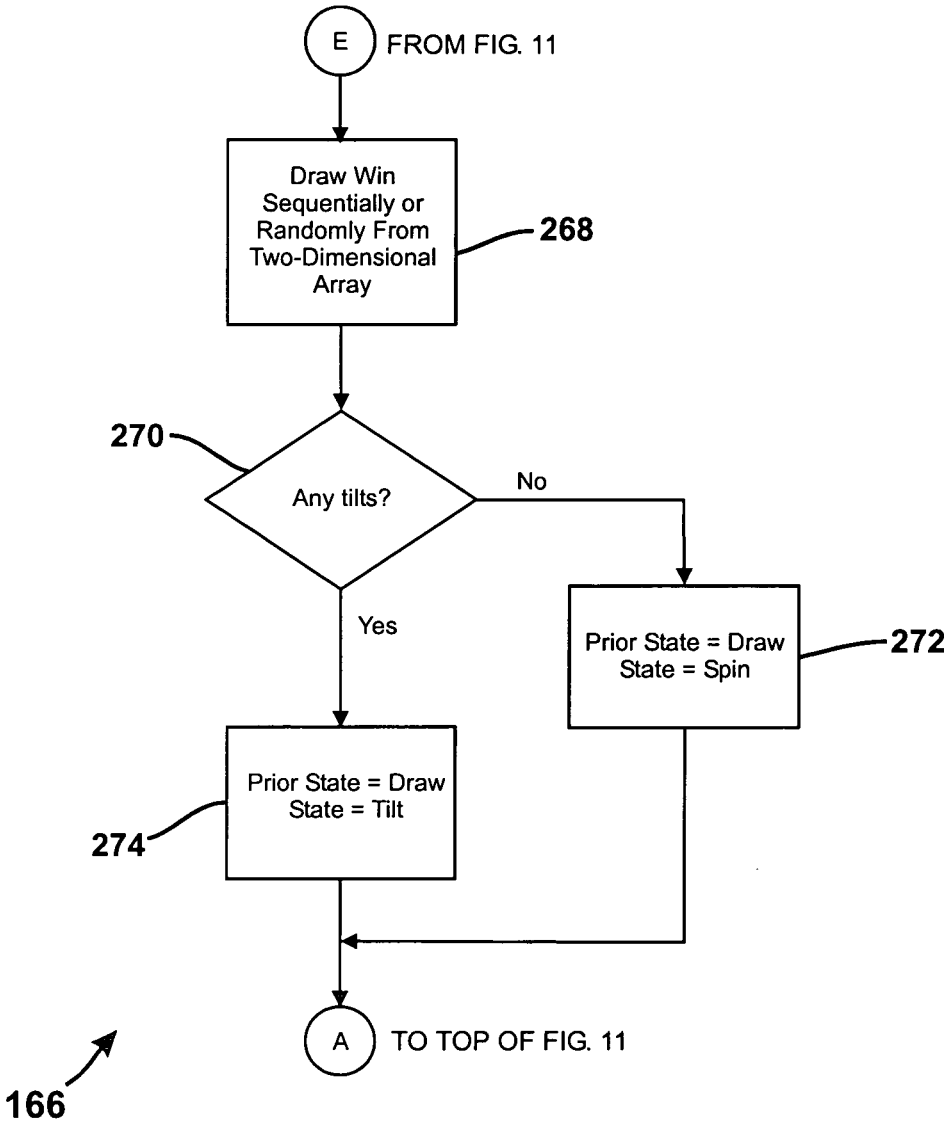
FIG. 14A is a flow chart of an alternative embodiment of the present invention illustrating a draw reel stops state sub-routine of conditional state routine in FIG. 11.

In FIG. 11, the conditional state routine 156 further comprises a decisional prompt at step 264 to determine and evaluate the draw reel stops state sub-routine 166 upon completing or satisfying the conditions set forth in the bet state sub-routine at step 250. In FIG. 14, the draw reel stops state sub-routine is initially evaluated by a command at step 158 to retrieve a random number from the random number generator 148 for each reel wheel 18 and process this information within a predetermined time period and in accord with the instruction set in the application program, particularly in the manner prescribed above to establish the stopping position of each reel wheel or completion of the reel wheel spin cycle. In the alternative embodiment of the present invention, as depicted in FIG. 14A, the draw reel stops state sub-routine 166 is modified at step 266, notably by the replacement of step 266 by step 268 which commands selection of a case outcome, either sequentially or randomly, from a two-dimensional array which in either case suitably serves in establishing the number of steps or pulses delivered to each of the stepper motors via the motor driver 132 to complete the reel spin cycle, substantially in the manner described above. In succeeding commands, the alternative embodiment operates in like manner as the preferred embodiment of the memento dispensing device, as illustrated in FIGS. 14 and 14A. At step 270, the draw reel stops state sub-routine 166 is further evaluated by a decisional prompt to determine the presence of tilt conditions capable of making the memento dispensing device 10 inoperable, and if none are present, the draw reel stops state sub-routine at step 272 is re-assigned to a spin state sub-routine 170 for continued evaluation of conditions provided therein. If tilt conditions exists in such manner to cause the memento dispensing device to become inoperative, the draw reel stops state sub-routine at step 274 is re-assigned to the tilt state sub-routine 168 for evaluation of conditions set forth therein, particularly to determine the cause of internal errors attributing to the memento dispensing device's unavailability to operate.

Figure 15:
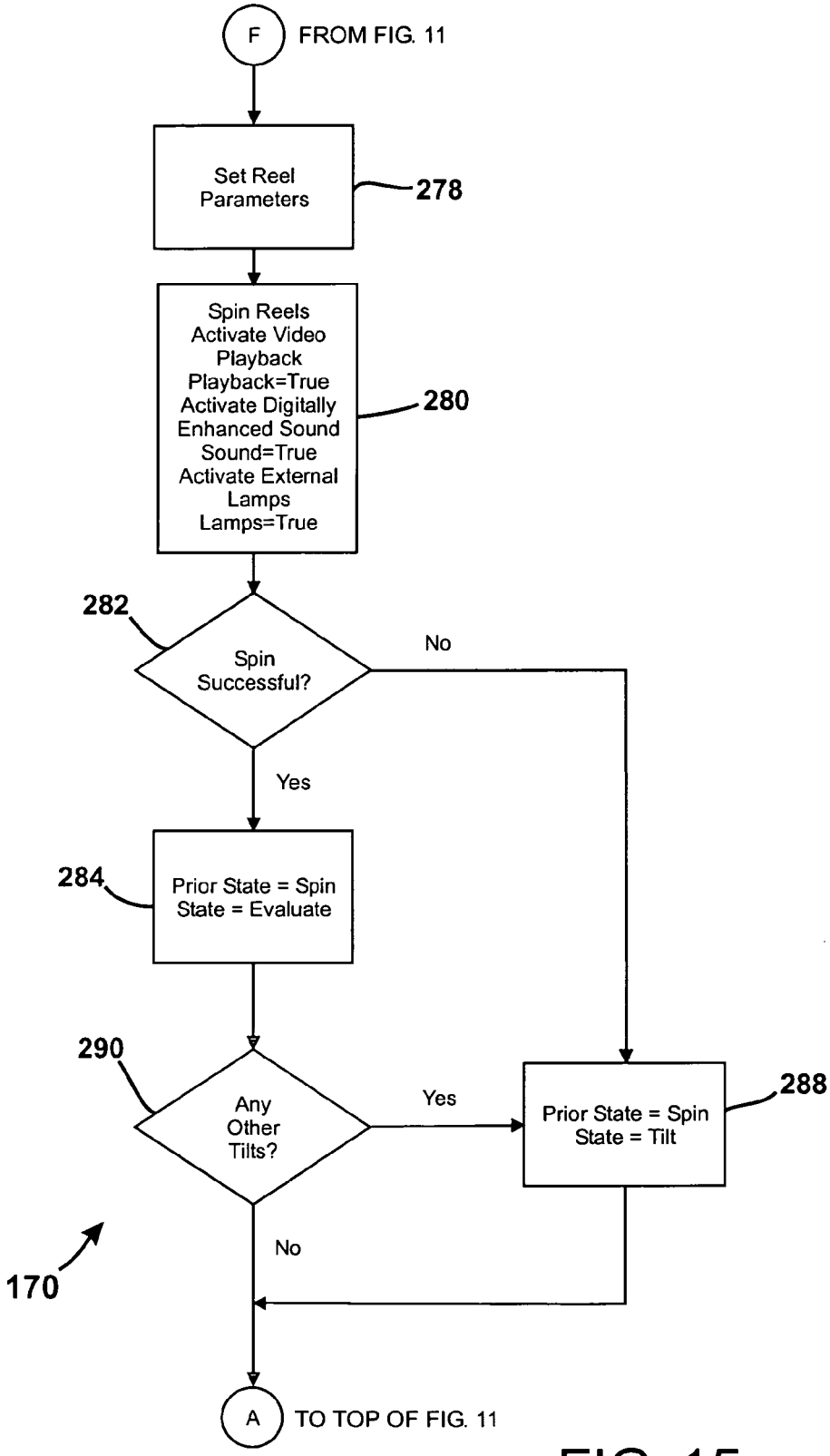
FIG. 15 is a flow chart of the preferred embodiment of the present invention illustrating a spin state sub-routine of conditional state routine in FIG. 11.

In FIG. 11, the conditional state routine 156 further comprises a decisional prompt at step 276 to determine and evaluate the spin state sub-routine 170 upon completing or satisfying the conditions set forth in the draw reel stops state sub-routine 166, at step 264. In FIG. 15, the spin state sub-routine is initially evaluated by a command at step 278 to set the operating parameters for each of the reel wheels 18, namely the setting of direction of rotation for each of the reel wheels and voltages therefor from a predetermined low state for an inoperative condition of the memento dispensing device 10 to a predetermined high state for a reel wheel spin condition. At step 280, the spin state sub-routine is further evaluated by a command to spin each of the reel wheels in a predetermined direction as prescribed in the previous command at step 278 and activate sound generation via operation of digitally enhanced sound means 106, activate video playback means 68 for display of stored video footage on the video monitor 74 and activate external lamps 150 such as the illuminated candle. The spin state sub-routine 170 further comprises a decisional prompt at step 282 to determine whether the spin was successful without the presence of internal errors, and if so, the spin state sub-routine is re-assigned at step 284 to an evaluate state sub-routine 172 commencing at step 286 in the conditional state routine 156 depicted in FIG. 11, specifically to set the numeric count for evaluation by a pay state sub-routine 174. If the reel wheel spin was not successful, the spin state sub-routine 170 is further evaluated by a command at step 288 to re-assign the spin state sub-routine to the tilt state sub-routine 168 for evaluation of conditions set forth therein to assess and determine the cause of internal errors attributing to the memento dispensing device's unavailability to operate. At step 290, following step 284, the spin state sub-routine is further evaluated by a decisional prompt to determine the presence of any other tilt conditions, and if present, the spin state sub-routine is further evaluated by a command to correct this condition in such manner prescribed for in step 288, otherwise the spin state sub-routine 170 continues to the conditional state routine 156 in FIG. 11 for further evaluation of conditions provided therein.

Figure 16:
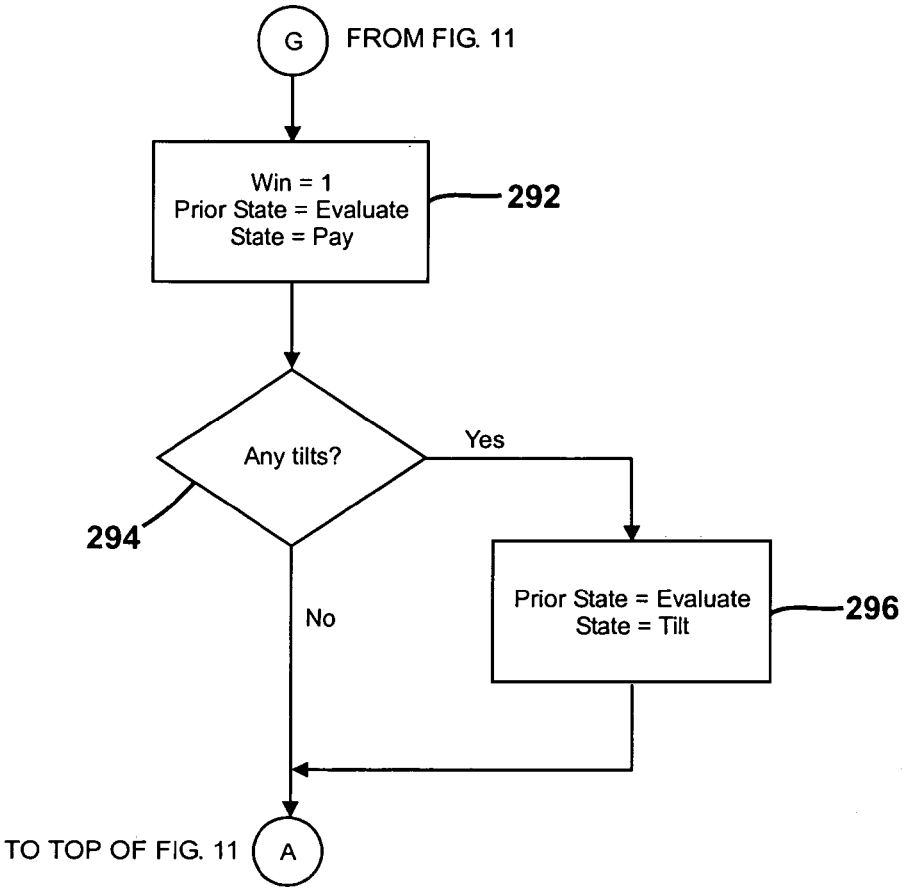
FIG. 16 is a flow chart of the preferred embodiment of the present invention illustrating a evaluate state sub-routine of conditional state routine in FIG. 11.

In FIG. 11, the conditional state routine proceeds in evaluating the evaluate state sub-routine at step 286 upon completing or satisfying the previous conditions set forth in the spin state sub-routine at step 276. In FIG. 16, the evaluate state sub-routine 172 is initially evaluated by a command at step 292 to set a win value to a numeric value of one and re-assign the evaluate state sub-routine to the pay state sub-routine 174 for further evaluation of conditions set forth therein. A decision prompt at step 294 is provided in the evaluate state sub-routine 172 to determine the presence of any tilt conditions, and if so, at step 296, the evaluate state sub-routine is re-assigned to the tilt state sub-routine 168 for evaluation of conditions provided therein, otherwise the evaluate state sub-routine continues to the conditional state routine in FIG. 11 for further evaluation of conditions provided therein.

Figure 17:
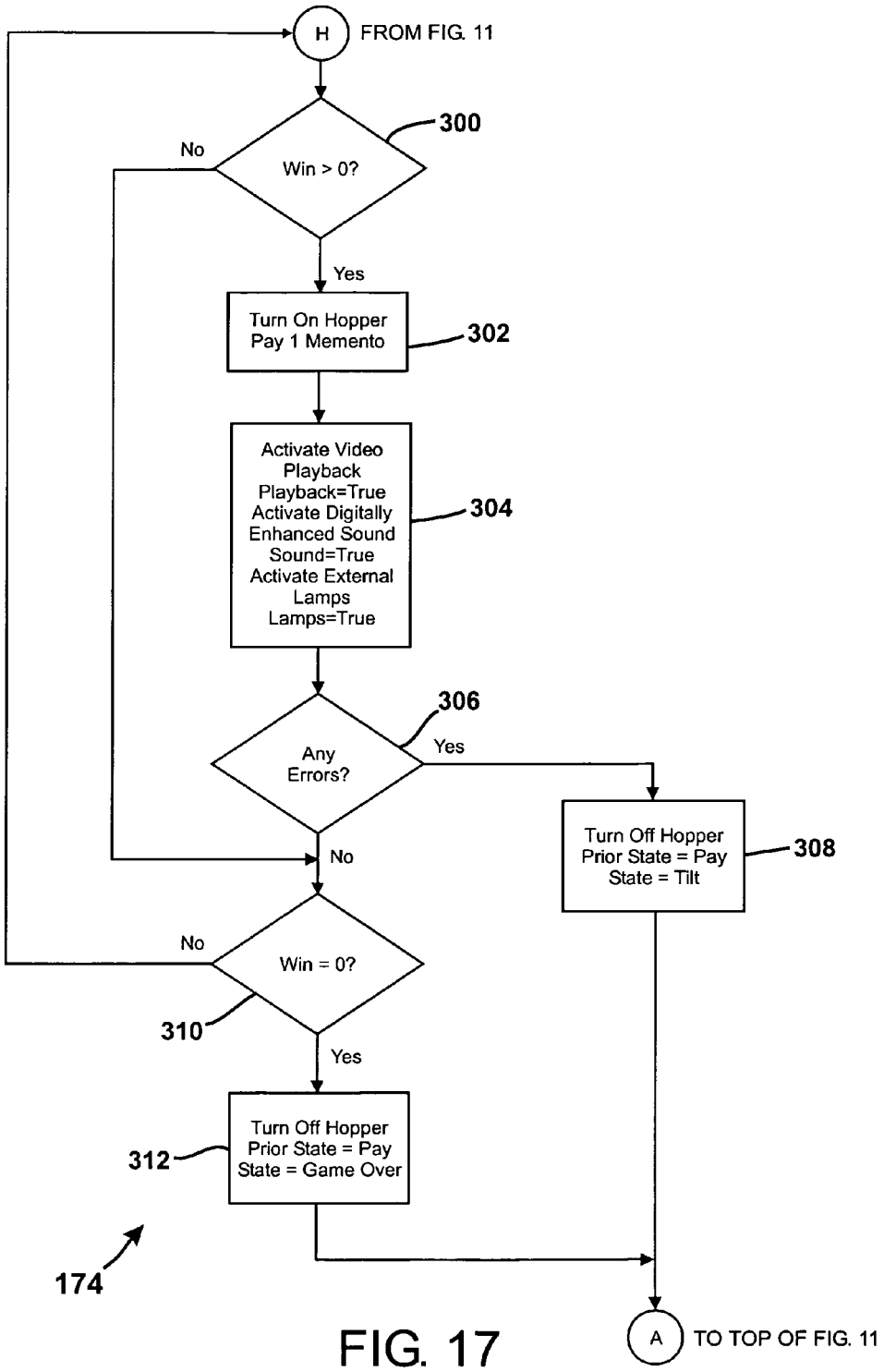
FIG. 17 is a flow chart of the preferred embodiment of the present invention illustrating a play state sub-routine of conditional state routine in FIG. 11.

In FIG. 11, the conditional state routine 156 further comprises a decisional prompt at step 298 to determine and evaluate the pay state sub-routine 174 upon completing or satisfying the conditions set forth in the evaluate state sub-routine at step 286. In FIG. 17, the pay state sub-routine is initially evaluated by a decisional prompt at step 300 to determine whether the state of win is greater than the numeric value of zero, and if so, at step 302 the main microcontroller 118 communicates with the hopper 56 via the hopper controller 58 to dispense one memento from the hopper into the reservoir 60 via the chute 54. In alternative embodiments of the present invention, the pay state sub-routine 174 comprises a supplementary command at step 304 to activate digitally enhanced sound means 106 for audio playback and/or video playback means 68 to display on an associated monitor preselected video footage in the nature of advertisements and the like for a predetermined amount of time and/or activate external lamps 150 to signify to others the dispending of a memento. After dispensing one memento from the hopper as provided for in step 302, the pay state sub-routine 174 is further evaluated by a decisional prompt at step 306 to determine the presence of internal errors, such as in the instance where the memento is jammed in the memento bin or hopper assembly or a hopper trip sensor integrally made part of the hopper assembly and operating at a timed interval fails to make a proper memento count within an allotted timeframe. If in the event of internal errors at step 306, the hopper is deactivated and the pay state sub-routine is further evaluated by a command at step 308 to re-assign the pay state sub-routine to the tilt state sub-routine 168 for evaluation of conditions provided therein. If errors in step 306 are not present or the numeric value of the win is not greater than zero as provided for at step 300, the pay state sub-routine proceeds to the decisional prompt at step 310 to determine whether the win is equal to zero, and if so, the hopper assembly is deactivated and the pay state sub-routine is re-assigned to the game over state sub-routine 158 at step 312. If the win is not zero at step 310, then the pay state sub-routine is re-evaluated at step 298 in the conditional state routine 156.

Figure 18:
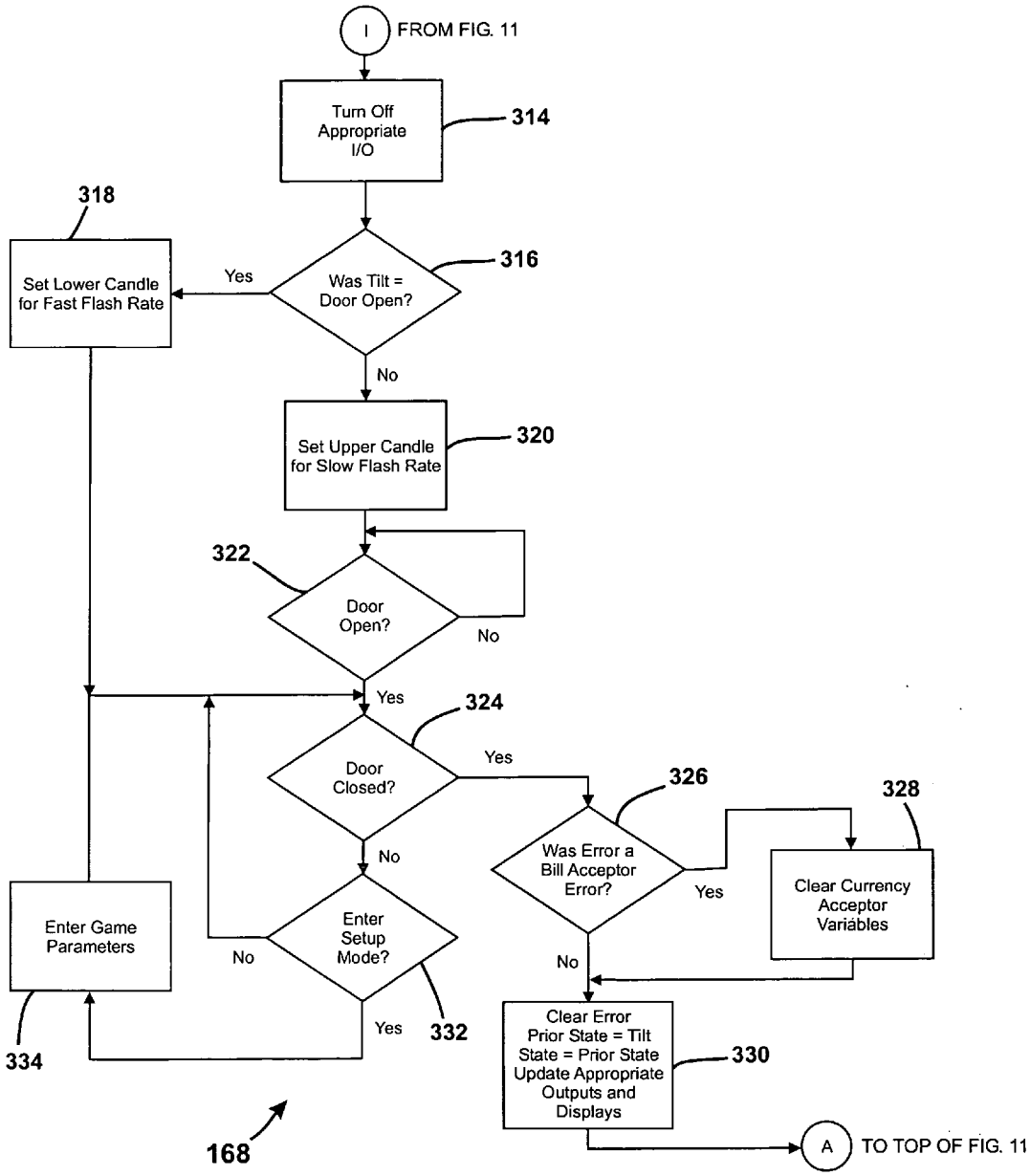
FIG. 18 is a flow chart of the preferred embodiment of the present invention illustrating a tilt state sub-routine of conditional state routine in FIG. 11.

In FIG. 11, the conditional state routine provides for at step 262 the activation and evaluation of conditions in the tilt state sub-routine 168, particularly as it is prompted in other conditional state sub-routines, such as at step 308 in FIG. 17 and so forth. In FIG. 18, once prompted in this regard, the tilt state sub-routine is initially evaluated by a command at step 314 to deactivate appropriate input and output devices, such as the spin and bet max switches 30, 32, spin lever 24, currency acceptor 44, and so forth, with exception of the LED which suffices to display internal error codes to the attendant and the reset momentary switch 160 which suffices as means for clearing internal error code data and the like accumulated in RAM. At step 316, the tilt state sub-routine 168 is further evaluated by a decisional prompt to determine whether the position of the access door 62 is attributed to the tilt condition in such manner that the memento dispensing device 10 becomes unavailable for operation. If the access door is determined to be in an open state, at step 318, the lower lighted portion of the candle is activated for a rapid flash rate to signify this condition to the operator and attendant necessitating correction. If the tilt condition is not attributed to the door's position, then the upper lighted portion of the candle is activated for a slow flash rate at step 320 to signify a tilt condition caused by another operable condition. Correction of error codes or tilt conditions is primarily managed by the opening and closing of the access door 62 which activates the reset momentary switch, notably as provided for in decisional prompts 322 and 324. In this regard, the access door awaits opening at step 322 and continues to cycle in this manner until such time the access door is in an open position. If and when the door is open, the decisional prompt at step 324 determines whether the access door is now in a closed position, and if so, a further decisional prompt at step 326 determines the nature of the error or tilt condition, namely one that is attributed to the currency acceptor 44. If so, at step 328, the currency acceptor is cleared of its operating variables before further evaluation is made at step 330. At step 330, the tilt state sub-routine is re-assigned to the prior state sub-routine operating before recognition of the tilt condition and appropriate outputs and displays are updated to the previous operative condition, including re-activation of the spin and max bet switches and spin lever as well as reinstatement of the number of credits accumulated during play or operation of the memento dispensing device 10. If the access door is not closed as provided for at step 324, then the tilt state sub-routine 168 is further evaluated by a decisional prompt at step 332 to determine the desire to enter into a setup mode for setting or re-setting of operating parameters. If so, operating parameters are changed or altered accordingly at step 334 to include for example the re-setting of denominations acceptable for input into the currency acceptor 44 and the like. After making the appropriate change to the operating parameters in this regard at step 334 or after a decision not to change such parameters at step 332, further re-evaluation of conditions is made in the tilt state sub-routine at step 324 and thereafter until resolution of the tilt condition or internal error.

In operation of the present invention, appropriate denomination of currency is placed into the bill insertion slot 36 of the bill validator 46 or into the coin acceptor 48 which determines the validity of the currency to establish a credit reserve for display on the numeric display counter 42 and initialize process controller means to permit activation of either the spin or max bet switches or spin lever. Activation of either the spin or max bet switch 30, 32 or spin lever 24 by the operator or consumer appropriately sets in rotational motion each of the reel wheels 18 appearing through the divided display windows 16 of the memento dispensing device 10. The collection of reel wheels is permitted to operate and rotate for a timed interval while process controller means algorithmically computes case outcomes determinative of the reel wheels' stopped positions. Upon expiration of the time interval, process controller means 34 commands each of the reel wheels to stop in succession from left to right, after which time process controller means transmits an electronic pulse to the hopper controller 58 to activate the memento bin or hopper assembly 56 to release a memento therefrom. The memento's engagement with the hopper trip sensor or mechanical trigger inherently made part of the hopper assembly and controlled by the hopper controller permits the memento to pass through the chute 54 and fall and collect into the reservoir 60 for retrieval by the operator.

It can be seen from the foregoing that there is provided in accordance with this invention a simple and easily operated device, which is particularly suitable for operation at an establishment to dispense mementos while simultaneously providing an opportunity to the establishment to promote or advertise a certain product or service. The memento dispensing device 10 is capable of automated operation and readily dispenses mementos in the form of tokens, medallions, souvenirs, and other articles or objects having commemorative value. The memento dispensing device suitably serves to attract and entertain patrons and the like for a predetermined amount of time by the activation of lights, sound, and video. Patrons, during operation of the memento dispensing device, are further entertained by engaging in an interactive event which simulates play of a gaming machine typically known in the art as a slot machine. Since the memento dispensing device solely operates as a dispensing device and not as a gaming device, it can be readily placed in establishments for promotional purposes where slot machines and other games of chance are typically prohibited to operate. The memento dispensing device may effectively serve an establishment in creating added revenue streams to promote goods and services of other establishments. In other respects, the memento dispensing device can adequately serve as means for dispensing commemorative tokens having redemption value for a product or service at a later time, which may supplement an establishment's theme for an enhanced marketing campaign.

While there has been shown and described a particular embodiment of the invention, it will be obvious to those skilled in the art that various changes and alterations can be made therein without departing from the invention and, therefore, it is aimed in the appended claims to cover all such changes and alterations which fall within the true spirit and scope of the invention.

What is claimed is:

1. A memento dispensing device comprising:

a plurality of reel wheels, each of said reel wheels having a plurality of symbols pictorially displayed thereon and a plurality of reel wheel stop positions positionally coinciding with said symbols;

at least one stepper motor for rotatably driving said reel wheels in a controlled operable manner;

a motor driver connectively coupled to said stepper motor and suitably configured to accept and receive operative commands to selectively control operation of said stepper motor;

process controller means for coordinating activation and deactivation of said motor driver to commence and consummate a reel spin cycle for each of said reel wheels;

an input interface device communicatively coupled to and substantially suited to prompt said process controller means to activate said motor driver;

a resident memory module integrated within said process controller means for storing an application program having an instruction set for calculably deriving case outcomes each assignably associated with said reel wheel stop position and said symbol coinciding therewith, wherein each of said case outcomes is operably associated with a pre-defined set of matching symbols representable of a perceived winning combination for display on said reel wheels and a predetermined number of pulses deliverable to said stepper motor to rotatably drive said reel wheels beyond a home flagged position to display accordingly said matching symbols associated with said reel wheel stop position, each of said case outcomes sequentially occurring in numeric order starting with a first case outcome and ending with a last case outcome and restarting with said first case outcome upon completing said last case outcome;

a currency acceptor communicatively coupled to said process controller means for validating the form and denomination of currency and storing into a random access memory module a validated amount of currency recognizable as credit reserve to initialize said process controller means to make active said input interface device; and a hopper assembly having means for storing mementos and means for dispensing at least one memento momentarily after recognition of a completed reel spin cycle for all of said reel wheels irrespective of said case outcome and display of said symbol associated therewith.

2. A memento dispensing device of claim 1, wherein each of said reel wheels comprises a circumferential periphery for attaching thereto a reel strip bearing said symbols.

3. A memento dispensing device of claim 1, wherein said process controller means comprises a main microcontroller for executing control operations in accord with said instruction set residing in said resident memory module and said random access memory module for temporary storage of input and output data accumulated during operation thereof.

4. A memento dispensing device of claim 3, wherein said main microcontroller communicates with a random number generator operatively associated with a random number generating algorithm and substantially serving to compute a random number based on a numeric seed value retrieved from a real time clock.

5. A memento dispensing device of claim 4, wherein each of said case outcomes is based on a reduced numeric value algorithmically derived from the random number and comparatively evaluated with a pre-select range of reduced numeric values assignable to each of said reel wheel stop positions.

6. A memento dispensing device of claim 1, further comprising a cabinet having back and front panels selectively joined to a pair of side panels to form an interior compartment having an upper portion configurably arranged therewithin, said front panel having divided display windows numerically corresponding to the number of said reel wheels to permit select observation of said symbols therethrough.

7. A memento dispensing device of claim 6, wherein said input interface device comprises at least one illuminated switch communicatively coupled to said process controller means and accessibly mounted to said cabinet.

8. A memento dispensing device of claim 6, wherein said input interface device comprises at least one spin lever communicatively coupled to said process controller means and accessibly mounted to said cabinet.

9. A memento dispensing device of claim 6, wherein said front panel comprises primary upper and lower translucent surfaces each suitably configured for accepting and mounting therebehind printed matter depicting a promotional advertisement and an access door for gaining entry into said interior compartment of said cabinet.

10. A memento dispensing device of claim 9, further comprising a back-light fixture mounted within said interior compartment, behind said primary upper translucent surface, to illuminate said promotional advertisement situated and displayed thereon.

11. A memento dispensing device of claim 6, wherein each of said side panels comprise a secondary translucent surface suitably configured for accepting and mounting therebehind printed matter depicting a promotional advertisement.

12. A memento dispensing device of claim 1, wherein said hopper assembly comprises a hopper controller communicatively coupled to said process controller means for regulating operation of said dispensing means, said storing means comprising a memento bin designated to store in reserve a collective amount of mementos, said dispensing means comprising a hopper trip sensor operably managed by said hopper controller, a chute connected to said memento bin for passing therethrough said memento as it is selectively released from said memento bin upon activating said hopper trip sensor and a reservoir connected to said chute.

13. A memento dispensing device of claim 1, further comprising a numeric display counter for displaying the validated amount of currency calculably posted as credit reserve and a change-out switch for dispensing the residual amount of credit reserve displayed on said numeric display counter, said numeric display counter and said change-out switch each being communicatively coupled to said process controller means.

14. A memento dispensing device of claim 1, wherein said currency acceptor accepts paper currency of common denominations for validation and rejects paper currency deemed invalid or of an improper denomination through a return slot and comprises a numeric display counter for display of the validated amount of currency recognizable as credit reserve.

15. A memento dispensing device of claim 1, wherein said currency acceptor accepts currency in the form of coins for validation and comprises a numeric display counter for display of the validated amount of currency recognizable as credit reserve.

16. A memento dispensing device of claim 6, further comprising a reel wheel bracket supportive of said reel wheels and having an associated encoder and an optic sensor collectively mounted thereto and communicatively coupled to said process controller means, said encoder functioning to assist said process controller means in sensing the rotational position of each of said reel wheels and ensure proper display of said symbol in said divided display window upon completing said reel spin cycle, said optic sensor functioning to reference and communicate with said process controller means a home flagged position of said reel wheel upon optic interruption.

17. A memento dispensing device of claim 1, further comprising means for deactivating process controller means upon recognition of an observable tilt condition caused by internal failure thereof.

18. A memento dispensing device of claim 17, wherein said deactivating means comprises means for activating an illuminated candle to visually signify an inoperative condition of said process controller means.

19. A memento dispensing device of claim 6, further comprising means for playing video on a video monitor housed within said upper portion of the interior compartment.

20. A memento dispensing device of claim 19, wherein said video playing means is activated upon commencing a first reel spin cycle for a first reel wheel and continues to actively operate for a predetermined period of time thereafter.

21. A memento dispensing device of claim 19, wherein said video playing means is activated upon dispensing said memento from said hopper assembly and continues to actively operate for a predetermined period of time thereafter.

22. A memento dispensing device of claim 19, wherein said video playing means is activated upon recognition of the validated amount of currency calculably posted as credit reserve and continues to actively operate for a predetermined period of time thereafter.

23. A memento dispensing device of claim 19, wherein said video playing means comprises a consumer-based video playback device operably controlled apart from said process controller means and having manually operable switching capabilities for controlled playback of video stored on recognizable formats for a predetermined length of time.

24. A memento dispensing device of claim 19, wherein said video playing means further comprises means for remote operation thereof.

25. A memento dispensing device of claim 24, wherein said video playing means comprises a video microcontroller communicatively coupled to said process controller means and having onboard switching capabilities supplementary to said remote operation means, said video microcontroller being connectively coupled to a hard drive for resident storage of video in a recognizable format, a memory card reader for accessing and reading video stored on compact flash media, and means for emitting sound contemporaneously produced and stored with the video.

26. A memento dispensing device of claim 25, wherein said sound emitting means comprises a digital and analog converter for receiving and converting a digital audio signal into an analog audio signal suited for input into an amplifier having outputs connected to speakers.

27. A memento dispensing device of claim 19, wherein said video playing means comprises a video playback card communicatively coupled to said process controller means and having inherently configured storage medium suited for storing video of a recognizable format for processing by said video playback card for output to said video monitor.

28. A memento dispensing device of claim 25, wherein said remote operation means comprises a remote control transmitter for transmitting infrared signals to a receiver connectively coupled to said video microcontroller for activation thereof.

29. A memento dispensing device of claim 25, wherein said remote operation means comprises a motion sensor connectively coupled to said video microcontroller for sensing the presence and movement of a nearby object for which serves to prompt said video microcontroller to playback stored video on said video monitor.

30. A memento dispensing device of claim 1, further comprising means for producing digitally enhanced sound, said digitally enhanced sound means being connectively coupled speakers for emitting sound.

31. A memento dispensing device of claim 30, wherein said producing digitally enhanced sound means comprises a sound generator communicatively coupled to said process controller means for activation and control thereby and an audio amplifier connectively coupled to said sound generator for amplifying an analog audio signal emitted therefrom for output to said speakers.

32. A memento dispensing device of claim 30, wherein said producing digitally enhanced sound means comprises a programmable sound generator communicatively coupled to said main process controller means and having an integrated circuit for producing a wide variety of complex sounds under software control and an onboard memory module for storing produced complex sounds, said programmable sound generator comprising a sound microcontroller operably dedicated to produce complex sounds and an audio amplifier for amplifying complex sounds produced therefrom for output to said speakers.

33. A memento dispensing device of claim 30, wherein said producing digitally enhanced sound means is activated upon commencing a first reel spin cycle for a first reel wheel and continues to actively operate for a predetermined period of time thereafter.

34. A memento dispensing device of claim 6, further comprising an illuminated candle situated and mounted atop said cabinet and means for illuminating said illuminated candle.

35. A memento dispensing device of claim 34, wherein said illuminating means is connectively coupled to said process controller means and is activated upon commencing a first reel spin cycle for a first reel wheel and continues to actively operate for a predetermined period of time thereafter.

36. A memento dispensing device of claim 34, wherein said illuminating means is connectively coupled to said process controller means and is activated upon dispensing said memento from said hopper assembly and continues to actively operate for a predetermined period of time thereafter.

37. A memento dispensing device with simulated gaming features, said device comprising:

a plurality of reel wheels, each of said reel wheels having a plurality of symbols pictorially displayed thereon and a plurality of reel wheel stop positions positionally coinciding with said symbols;

a plurality of stepper motors numerically corresponding to the number of said reel wheels to cause rotatable movement thereof;

a motor driver connectively coupled to said stepper motors and suitably configured to accept and receive operative commands to selectively control operation of said stepper motors;

a main microcontroller for coordinating activation and deactivation of said motor driver to commence and consummate a reel spin cycle for each of said reel wheels;

an input interface device communicatively coupled to and substantially suited to prompt said main microcontroller to activate said motor driver;

a cabinet having back and front panels selectively joined to a pair of side panels to form an interior compartment having an upper portion configurably arranged therewithin, one side panel substantially sufficing as a surface for mounting thereon said input interface device, said front panel having divided display windows numerically corresponding to the number of reel wheels to permit select observation of said symbols therethrough and primary upper and lower translucent surfaces each suitably configured for accepting and mounting therebehind printed matter depicting a promotional advertisement;

a resident memory module communicatively coupled to said main microcontroller for storing an application program having an instruction set for calculably deriving case outcomes each assignably associated with said reel wheel stop position and said symbol coinciding therewith, wherein each of said case outcomes is operably associated with a pre-defined set of matching symbols representable of a perceived winning combination for display on said reel wheels and a predetermined number of pulses deliverable to each of said stepper motors to rotatably move each of said reel wheels beyond the home flagged position to display accordingly in said divided display windows said matching symbols associated with said reel wheel stop position, each of said case outcomes sequentially occurring in numeric order starting with a first case outcome and ending with a last case outcome and restarting with said first case outcome upon completing said last case outcome;

reel wheel bracket assembly supportive of said reel wheels and having an associated encoder and an optic sensor collectively mounted thereto and communicatively coupled to said main microcontroller, said encoder functioning to assist said main microcontroller in sensing said reel wheel stop positions for said reel wheels and ensure proper display of said symbols associated therewith in said divided display window upon completing said reel spin cycles, said optic sensor functioning to reference and communicate with said main microcontroller a home flagged position for each of said reel wheels upon optic interruption;

means for playing video on a video monitor housed within said upper portion of the interior compartment;

means for producing digitally enhanced sound, said digitally enhanced sound means being connectively coupled to speakers for emitting sound exteriorly of said cabinet;

a currency acceptor communicatively coupled to said main microcontroller for validating the form and denomination of currency and storing into a random access memory module communicatively coupled to said main microcontroller a validated amount of currency recognizable as credit reserve to initialize said main microcontroller to make active said input interface device; and a hopper assembly having a memento bin designated to store in reserve a collective amount of mementos and a hopper controller communicatively coupled to said main microcontroller for regulating the release of at least one memento momentarily after recognition of a completed reel spin cycle for all of said reel wheels irrespective of said case outcome and display of said symbol associated therewith, said memento bin having a hopper trip sensor operably associated with and managed by said hopper controller a chute connected to said memento bin for passing therethrough said memento as permitted for release by said hopper trip sensor and a reservoir connected to said chute and mounted exteriorly of said cabinet.

38. A memento dispensing device of claim 37, wherein said instruction set is operably associated with a random number generator to compute a random number based on a numeric seed value retrieved from a real time clock and derived from a random number generating algorithm.

39. A memento dispensing device of claim 38, wherein each of said case outcomes is based on a reduced numeric value algorithmically derived from the random number and comparatively evaluated with a pre-select range of reduced numeric values assignable to each of said reel wheel stop positions.

40. A memento dispensing device of claim 37, wherein said video playing means comprises a video microcontroller communicatively coupled to said main microcontroller and having onboard switching capabilities; said video microcontroller being connectively coupled to a hard drive for resident storage of video in a recognizable format, a memory card reader for accessing and reading video stored on compact flash media, and a digital and analog converter for receiving and converting a digital audio signal contemporaneously produced and stored with the video into an analog audio signal suited for input into an amplifier having outputs connected to said speakers.

41. A memento dispensing device of claim 37, wherein said video playing means comprises a consumer-based video playback device operably controlled apart from said main microcontroller and having manually operable switching capabilities for controlled playback of video stored on recognizable formats for a predetermined length of time.

42. A memento dispensing device of claim 37, wherein said producing digitally enhanced sound means comprises a sound generator communicatively coupled to said main microcontroller for activation and control thereby and an audio amplifier connectively coupled to said sound generator for amplifying an analog audio signal emitted therefrom for output to said speakers.

43. A memento dispensing device of claim 37, wherein said producing digitally enhanced sound means comprises a programmable sound generator communicatively coupled to said main microcontroller and having an integrated circuit for producing a wide variety of complex sounds under software control and an onboard memory module for storing produced complex sounds, said programmable sound generator comprising a sound microcontroller operably dedicated to produce complex sounds and an audio amplifier for amplifying complex sounds produced therefrom for output to said speakers.

44. A memento dispensing device of claim 37, wherein said video playing means and said producing digitally enhanced sound means are simultaneously activated upon commencing a first reel spin cycle for a first reel wheel and continue to actively operate for a predetermined period of time thereafter.

45. A memento dispensing device of claim 37, wherein said video playing means and said producing digitally enhanced sound means are simultaneously activated upon dispensing said memento from said hopper assembly and continue to actively operate for a predetermined period of time thereafter.

46. A memento dispensing device of claim 37, wherein said video playing means and said producing digitally enhanced sound means are simultaneously activated upon recognition of credit reserve and continue to actively operate for a predetermined period of time thereafter.

47. A memento dispensing device comprising:

a plurality of virtual reel wheels, each of said virtual reel wheels having a plurality of virtual symbols pictorially displayed thereon and a plurality of simulated reel wheel stop positions positionally coinciding with said virtual symbols;

means for graphically producing said virtual reel wheels and said virtual symbols;

an electronic display operably associated with said graphically producing means to display said virtual reel wheels and said virtual symbols;

a main microcontroller communicatively coupled to said electronic display and having a resident memory module for storing said graphically producing means and an application program having an instruction set for calculably deriving case outcomes each assignably associated with said simulated reel wheel stop position and said virtual symbol coinciding therewith, wherein each of said case outcomes is operably associated with a pre-defined set of matching virtual symbols representable of a perceived winning combination for display on said virtual reel wheels and a predetermined number of simulated pulses deliverable to said graphically producing means to symbolically represent rotatable movement of each of said virtual reel wheels beyond a simulated home position to display accordingly said matching virtual symbols associated with said simulated reel wheel stop position, each of said case outcomes sequentially occurring in numeric order starting with a first case outcome and ending with a last case outcome and restarting with said first case outcome upon completing said last case outcome;

an input interface device communicatively coupled to and substantially suited to prompt said main microcontroller to activate said graphically producing means to generate and simulate a virtual reel spin cycle for each of said virtual reel wheels;

a currency acceptor communicatively coupled to said main microcontroller for validating the form and denomination of currency and storing into a random access memory module communicatively coupled to said main microcontroller a validated amount of currency recognizable as credit reserve to initialize said main microcontroller to make active said input interface device; and a hopper assembly for storing mementos and dispensing at least one memento momentarily after recognition of a completed reel spin cycle for all of said virtual reel wheels irrespective of said case outcome and display of said virtual symbol associated therewith.

48. A memento dispensing device of claim 47, wherein said main microcontroller communicates with a random number generator operatively associated with a random number generating algorithm contained with said instruction set and substantially serving to compute a random number based on a numeric seed value retrieved from a real time clock, each of said case outcomes being based on a reduced numeric value algorithmically derived from the random number and comparatively evaluated with a pre-select range of reduced numeric values assignable to each simulated reel wheel stop position and virtual symbol.

49. A memento dispensing device comprising:

a plurality of reel wheels, each of said reel wheels having a plurality of symbols pictorially displayed thereon and a plurality of reel wheel stop positions positionally coinciding with said symbols;

at least one stepper motor for rotatably driving said reel wheels in a controlled operable manner;

a motor driver connectively coupled to said stepper motor and suitably configured to accept and receive operative commands to selectively control operation of said stepper motor;

process controller means for coordinating activation and deactivation of said motor driver to commence and consummate a reel spin cycle for each of said reel wheels;

an input interface device communicatively coupled to and substantially suited to prompt said process controller means to activate said motor driver;

a resident memory module integrated within said process controller means for storing an application program having an instruction set for calculably deriving case outcomes each assignably associated with said reel wheel stop position and said symbol coinciding therewith, wherein each of said case outcomes is operably associated with a pre-defined set of matching symbols representable of a perceived winning combination for display on said reel wheels and a predetermined number of pulses deliverable to each of said stepper motors to rotatably move each of said reel wheels beyond a home flagged position to display accordingly said matching symbols associated with said reel wheel stop position, each of said case outcomes being randomly selected from within a range extending from a first case outcome and ending with a last case outcome;

a currency acceptor communicatively coupled to said process controller means for validating the form and denomination of currency and storing into a random access memory module a validated amount of currency recognizable as credit reserve to initialize said process controller means to make active said input interface device; and a hopper assembly having means for storing mementos and means for dispensing at least one memento momentarily after recognition of a completed reel spin cycle for all of said reel wheels irrespective of said case outcome and display of said symbol associated therewith.

50. A memento dispensing device of claim 49, wherein each of said reel wheels comprises a circumferential periphery for attaching thereto a reel strip bearing said symbols.

51. A memento dispensing device of claim 49, wherein said process controller means comprises a main microcontroller for executing control operations in accord with said instruction set residing in said resident memory module and said random access memory module for temporary storage of input and output data accumulated during operation thereof.

52. A memento dispensing device of claim 51, wherein said main microcontroller communicates with a random number generator operatively associated with a random number generating algorithm and substantially serving to compute a random number based on a numeric seed value retrieved from a real time clock.

53. A memento dispensing device of claim 52, wherein each of said case outcomes is based on a reduced numeric value algorithmically derived from the random number and comparatively evaluated with a pre-select range of reduced numeric values assignable to each of said reel wheel stop positions.

54. A memento dispensing device of claim 49, further comprising a cabinet having back and front panels selectively joined to a pair of side panels to form an interior compartment having an upper portion configurably arranged therewithin, said front panel having divided display windows numerically corresponding to the number of said reel wheels to permit select observation of said symbols therethrough.

55. A memento dispensing device of claim 54, wherein said input interface device comprises at least one illuminated switch communicatively coupled to said process controller means and accessibly mounted to said cabinet.

56. A memento dispensing device of claim 54, wherein said input interface device comprises at least one spin lever communicatively coupled to said process controller means and accessibly mounted to said cabinet.

57. A memento dispensing device of claim 54, wherein said front panel comprises primary upper and lower translucent surfaces each suitably configured for accepting and mounting therebehind printed matter depicting a promotional advertisement and an access door for gaining entry into said interior compartment of said cabinet.

58. A memento dispensing device of claim 57, further comprising a back-light fixture mounted within said interior compartment, behind said primary upper translucent surface, to illuminate said promotional advertisement situated and displayed thereon.

59. A memento dispensing device of claim 54, wherein each of said side panels comprise a secondary translucent surface suitably configured for accepting and mounting therebehind printed matter depicting a promotional advertisement.

60. A memento dispensing device of claim 59, wherein said hopper assembly comprises a hopper controller communicatively coupled to said process controller means for regulating operation of said dispensing means, said storing means comprising a memento bin designated to store in reserve a collective amount of mementos, said dispensing means comprising a hopper trip sensor operably managed by said hopper controller, a chute connected to said memento bin for passing therethrough said memento as it is selectively released from said memento bin upon activating said hopper trip sensor and a reservoir connected to said chute.

61. A memento dispensing device of claim 49, further comprising a numeric display counter for displaying the validated amount of currency calculably posted as credit reserve and a change-out switch for dispensing the residual amount of credit reserve displayed on said numeric display counter, said numeric display counter and said change-out switch each being communicatively coupled to said process controller means.

62. A memento dispensing device of claim 49, wherein said currency acceptor accepts paper currency of common denominations for validation and rejects paper currency deemed invalid or of an improper denomination through a return slot and comprises a numeric display counter for display of the validated amount of currency recognizable as credit reserve.

63. A memento dispensing device of claim 49, wherein said currency acceptor accepts currency in the form of coins for validation and comprises a numeric display counter for display of the validated amount of currency recognizable as credit reserve.

64. A memento dispensing device of claim 54, further comprising a reel wheel bracket supportive of said reel wheels and having an associated encoder and an optic sensor collectively mounted thereto and communicatively coupled to said process controller means, said encoder functioning to assist said process controller means in sensing the rotational position of each of said reel wheels and ensure proper display of said symbol in said divided display window upon completing said reel spin cycle, said optic sensor functioning to reference and communicate with said process controller means a home flagged position of said reel wheel upon optic interruption.

65. A memento dispensing device of claim 49, further comprising means for deactivating process controller means upon recognition of an observable tilt condition caused by internal failure thereof.

66. A memento dispensing device of claim 65, wherein said deactivating means comprises means for activating an illuminated candle to visually signify an inoperative condition of said process controller means.

67. A memento dispensing device of claim 54, further comprising means for playing video on a video monitor housed within said upper portion of the interior compartment.

68. A memento dispensing device of claim 67, wherein said video playing means is activated upon commencing a first reel spin cycle for a first reel wheel and continues to actively operate for a predetermined period of time thereafter.

69. A memento dispensing device of claim 67, wherein said video playing means is activated upon dispensing said memento from said hopper assembly and continues to actively operate for a predetermined period of time thereafter.

70. A memento dispensing device of claim 67, wherein said video playing means is activated upon recognition of the validated amount of currency calculably posted as credit reserve and continues to actively operate for a predetermined period of time thereafter.

71. A memento dispensing device of claim 67, wherein said video playing means comprises a consumer-based video playback device operably controlled apart from said process controller means and having manually operable switching capabilities for controlled playback of video stored on recognizable formats for a predetermined length of time.

72. A memento dispensing device of claim 67, wherein said video playing means further comprises means for remote operation thereof.

73. A memento dispensing device of claim 72, wherein said video playing means comprises a video microcontroller communicatively coupled to said process controller means and having onboard switching capabilities supplementary to said remote operation means, said video microcontroller being connectively coupled to a hard drive for resident storage of video in a recognizable format, a memory card reader for accessing and reading video stored on compact flash media, and means for emitting sound contemporaneously produced and stored with the video.

74. A memento dispensing device of claim 73, wherein said sound emitting means comprises a digital and analog converter for receiving and converting a digital audio signal into an analog audio signal suited for input into an amplifier having outputs connected to speakers.

75. A memento dispensing device of claim 67, wherein said video playing means comprises a video playback card communicatively coupled to said process controller means and having inherently configured storage medium suited for storing video of a recognizable format for processing by said video playback card for output to said video monitor.

76. A memento dispensing device of claim 73, wherein said remote operation means comprises a remote control transmitter for transmitting infrared signals to a receiver connectively coupled to said video microcontroller for activation thereof.

77. A memento dispensing device of claim 73, wherein said remote operation means comprises a motion sensor connectively coupled to said video microcontroller for sensing the presence and movement of a nearby object for which serves to prompt said video microcontroller to playback stored video on said video monitor.

78. A memento dispensing device of claim 49, further comprising means for producing digitally enhanced sound, said digitally enhanced sound means being connectively coupled speakers for emitting sound.

79. A memento dispensing device of claim 78, wherein said producing digitally enhanced sound means comprises a sound generator communicatively coupled to said process controller means for activation and control thereby and an audio amplifier connectively coupled to said sound generator for amplifying an analog audio signal emitted therefrom for output to said speakers.

80. A memento dispensing device of claim 78, wherein said producing digitally enhanced sound means comprises a programmable sound generator communicatively coupled to said process controller means and having an integrated circuit for producing a wide variety of complex sounds under software control and an onboard memory module for storing produced complex sounds, said programmable sound generator comprising a sound microcontroller operably dedicated to produce complex sounds and an audio amplifier for amplifying complex sounds produced therefrom for output to said speakers.

81. A memento dispensing device of claim 78, wherein said producing digitally enhanced sound means is activated upon commencing a first reel spin cycle for a first reel wheel and continues to actively operate for a predetermined period of time thereafter.

82. A memento dispensing device of claim 54, further comprising an illuminated candle situated and mounted atop said cabinet and means for illuminating said illuminated candle.

83. A memento dispensing device of claim 82, wherein said illuminating means is connectively coupled to said process controller means and is activated upon commencing a first reel spin cycle for a first reel wheel and continues to actively operate for a predetermined period of time thereafter.

84. A memento dispensing device of claim 82, wherein said illuminating means is connectively coupled to said process controller means and is activated upon dispensing said memento from said hopper assembly and continues to actively operate for a predetermined period of time thereafter.

85. A memento dispensing device with simulated gaming features, said device comprising:

a plurality of reel wheels, each of said reel wheels having a plurality of symbols pictorially displayed thereon and a plurality of reel wheel stop positions positionally coinciding with said symbols;

a plurality of stepper motors numerically corresponding to the number of said reel wheels to cause rotatable movement thereof;

a motor driver connectively coupled to said stepper motors and suitably configured to accept and receive operative commands to selectively control operation of said stepper motors;

a main microcontroller for coordinating activation and deactivation of said motor driver to commence and consummate a reel spin cycle for each of said reel wheels;

an input interface device communicatively coupled to and substantially suited to prompt said main microcontroller to activate said motor driver;

a cabinet having back and front panels selectively joined to a pair of side panels to form an interior compartment having an upper portion configurably arranged therewithin, one side panel substantially sufficing as a surface for mounting thereon said input interface device, said front panel having divided display windows numerically corresponding to the number of reel wheels to permit select observation of said symbols therethrough and primary upper and lower translucent surfaces each suitably configured for accepting and mounting therebehind printed matter depicting a promotional advertisement;

a resident memory module communicatively coupled to said main microcontroller for storing an application program having an instruction set for calculably deriving case outcomes each assignably associated with said reel wheel stop position and said symbol coinciding therewith, wherein each of said case outcomes is operably associated with a pre-defined set of matching symbols representable of a perceived winning combination for display on said reel wheels and a predetermined number of pulses deliverable to each of said stepper motors to rotatably move each of said reel wheels beyond the home flagged position to display accordingly in said divided display windows said matching symbols associated with said reel wheel stop position, each of said case outcomes being randomly selected from within a range extending from a first case outcome and ending with a last case outcome;

reel wheel bracket assembly supportive of said reel wheels and having an associated encoder and an optic sensor collectively mounted thereto and communicatively coupled to said main microcontroller, said encoder functioning to assist said main microcontroller in sensing said reel wheel stop positions for said reel wheels and ensure proper display of said symbols associated therewith in said divided display window upon completing said reel spin cycles, said optic sensor functioning to reference and communicate with said main microcontroller a home flagged position for each of said reel wheels upon optic interruption;

means for playing video on a video monitor housed within said upper portion of the interior compartment;

means for producing digitally enhanced sound, said digitally enhanced sound means being connectively coupled to speakers for emitting sound exteriorly of said cabinet;

a currency acceptor communicatively coupled to said main microcontroller for validating the form and denomination of currency and storing into a random access memory module communicatively coupled to said main microcontroller a validated amount of currency recognizable as credit reserve to initialize said main microcontroller to make active said input interface device; and a hopper assembly having a memento bin designated to store in reserve a collective amount of mementos and a hopper controller communicatively coupled to said main microcontroller for regulating the release of at least one memento momentarily after recognition of a completed reel spin cycle for all of said reel wheels irrespective of said case outcome and display of said symbol associated therewith, said memento bin having a hopper trip sensor operably associated with and managed by said hopper controller, a chute connected to said memento bin for passing therethrough said memento as permitted for release by said hopper trip sensor and a reservoir connected to said chute and mounted exteriorly of said cabinet.

86. A memento dispensing device of claim 85, wherein said instruction set is operably associated with a random number generator to compute a random number based on a numeric seed value retrieved from a real time clock and derived from a random number generating algorithm.

87. A memento dispensing device of claim 86, wherein each of said case outcomes is based on a reduced numeric value algorithmically derived from the random number and comparatively evaluated with a pre-select range of reduced numeric values assignable to each of said reel wheel stop positions.

88. A memento dispensing device of claim 85, wherein said video playing means comprises a video microcontroller communicatively coupled to said main microcontroller and having onboard switching capabilities, said video microcontroller being connectively coupled to a hard drive for resident storage of video in a recognizable format, a memory card reader for accessing and reading video stored on compact flash media, and a digital and analog converter for receiving and converting a digital audio signal contemporaneously produced and stored with the video into an analog audio signal suited for input into an amplifier having outputs connected to said speakers.

89. A memento dispensing device of claim 85, wherein said video playing means comprises a consumer-based video playback device operably controlled apart from said main microcontroller and having manually operable switching capabilities for controlled playback of video stored on recognizable formats for a predetermined length of time.

90. A memento dispensing device of claim 85, wherein said producing digitally enhanced sound means comprises a sound generator communicatively coupled to said main microcontroller for activation and control thereby and an audio amplifier connectively coupled to said sound generator for amplifying an analog audio signal emitted therefrom for output to said speakers.

91. A memento dispensing device of claim 85, wherein said producing digitally enhanced sound means comprises a programmable sound generator communicatively coupled to said main microcontroller and having an integrated circuit for producing a wide variety of complex sounds under software control and an onboard memory module for storing produced complex sounds, said programmable sound generator comprising a sound microcontroller operably dedicated to produce complex sounds and an audio amplifier for amplifying complex sounds produced therefrom for output to said speakers.

92. A memento dispensing device of claim 85, wherein said video playing means and said producing digitally enhanced sound means are simultaneously activated upon commencing a first reel spin cycle for a first reel wheel and continue to actively operate for a predetermined period of time thereafter.

93. A memento dispensing device of claim 85, wherein said video playing means and said producing digitally enhanced sound means are simultaneously activated upon dispensing said memento from said hopper assembly and continue to actively operate for a predetermined period of time thereafter.

94. A memento dispensing device of claim 85, wherein said video playing means and said producing digitally enhanced sound means are simultaneously activated upon recognition of credit reserve and continue to actively operate for a predetermined period of time thereafter.

95. A memento dispensing device comprising:

a plurality of virtual reel wheels, each of said virtual reel wheels having a plurality of virtual symbols pictorially displayed thereon and a plurality of simulated reel wheel stop positions positionally coinciding with said virtual symbols;

means for graphically producing said virtual reel wheels and said virtual symbols;

an electronic display operably associated with said graphically producing means to display said virtual reel wheels and said virtual symbols;

a main microcontroller communicatively coupled to said electronic display and having a resident memory module for storing said graphically producing means and an application program having an instruction set for calculably deriving case outcomes each assignably associated with said simulated reel wheel stop position and said virtual symbol coinciding therewith, wherein each of said case outcomes is operably associated with a predefined set of matching virtual symbols representable of a perceived winning combination for display on said virtual reel wheels and a predetermined number of simulated pulses deliverable to said graphically producing means to symbolically represent rotatable movement of each of said virtual reel wheels beyond a simulated home position to display accordingly said matching virtual symbols associated with said simulated reel wheel stop position, each of said case outcomes being randomly selected from within a range extending from a first case outcome and ending with a last case outcome;

an input interface device communicatively coupled to and substantially suited to prompt said main microcontroller to activate said graphically producing means to generate and simulate a virtual reel spin cycle for each of said virtual reel wheels;

a currency acceptor communicatively coupled to said main microcontroller for validating the form and denomination of currency and storing into a random access memory module communicatively coupled to said main microcontroller a validated amount of currency recognizable as credit reserve to initialize said main microcontroller to make active said input interface device; and a hopper assembly for storing mementos and dispensing at least one memento momentarily after recognition of a completed reel spin cycle for all of said virtual reel wheels irrespective of said case outcome and display of said virtual symbol associated therewith.

96. A memento dispensing device of claim 95, wherein said main microcontroller communicates with a random number generator operatively associated with a random number generating algorithm contained with said instruction set and substantially serving to compute a random number based on a numeric seed value retrieved from a real time clock, each of said case outcomes being based on a reduced numeric value algorithmically derived from the random number and comparatively evaluated with a pre-select range of reduced numeric values assignable to each simulated reel wheel stop position and virtual symbol.

* * * * *